US012742448B2

(12) United States Patent
Rislå et al.

(10) Patent No.: US 12,742,448 B2
(45) Date of Patent: Sep. 22, 2026

(54) PISTON COMPRESSOR VALVE ARRANGEMENT AND METHOD OF USE

(71) Applicant: Heaten AS, Kristiansand S (NO)

(72) Inventors: Harald Nes Rislå, Lillesand (NO); Christian Schlüter, Iserlohn (DE); Alexander Klaus Zaiss, Wuppertal (DE)

(73) Assignee: Heaten AS, Kristiansand S (NO)

( * ) Notice: Subject to any disclaimer, the term of this patent is extended or adjusted under 35 U.S.C. 154(b) by 0 days.

(21) Appl. No.: 18/992,861

(22) PCT Filed: Jan. 31, 2024

(86) PCT No.: PCT/NO2024/050025

§ 371 (c)(1),
(2) Date: Jan. 9, 2025

(87) PCT Pub. No.: WO2024/167414

PCT Pub. Date: Aug. 15, 2024

(65) Prior Publication Data

US 2026/0016000 A1 Jan. 15, 2026

(30) Foreign Application Priority Data

Feb. 8, 2023 (NO) ..... 20230126

(51) Int. Cl.
*F04B 39/10* (2006.01)
*F04B 39/00* (2006.01)

(52) U.S. Cl.
CPC ..... *F04B 39/1046* (2013.01); *F04B 39/1073* (2013.01); *F04B 39/0005* (2013.01)

(58) Field of Classification Search
CPC ..... F04B 39/1046; F04B 39/1073; F04B 39/0005
See application file for complete search history.

(56) References Cited

U.S. PATENT DOCUMENTS 231,059 A 8/1880 Leavitt, Jr.
1,273,366 A 7/1918 Heideman
1,632,385 A * 6/1927 Vollmann ..... F16K 15/1402 137/857
2,025,240 A * 12/1935 Higham ..... F16K 15/063 417/571

(Continued)

FOREIGN PATENT DOCUMENTS

CN 101979841 A 2/2011
CN 201739117 U 2/2011

(Continued)

OTHER PUBLICATIONS

Search Report for Norwegian Application No. 20230126, dated Sep. 4, 2023.

(Continued)

*Primary Examiner* — Dominick L Plakkoottam
(74) *Attorney, Agent, or Firm* — Andrus Intellectual Property Law, LLP

(57) ABSTRACT

A valve arrangement is for a piston compressor, the valve arrangement having: a suction valve section; and a discharge valve section; wherein the suction valve section and discharge valve section together form a working chamber head section, and the suction valve section has a frustopyramidal form.

20 Claims, 11 Drawing Sheets

(56) References Cited

U.S. PATENT DOCUMENTS

| | | | | | |
|---|---|---|---|---|---|
| 2,693,818 | A | | 11/1954 | Tucker | |
| 2,934,083 | A | * | 4/1960 | Norton | F16K 15/1401 137/856 |
| 3,774,581 | A | * | 11/1973 | Lundy | F01L 3/00 123/188.2 |
| 4,368,755 | A | * | 1/1983 | King | F04B 39/102 137/543.17 |
| 4,370,103 | A | | 1/1983 | Tripp | |
| 4,389,168 | A | | 6/1983 | Yannascoli | |
| 4,478,243 | A | | 10/1984 | King | |
| 4,690,619 | A | | 9/1987 | Iijima | |
| 2003/0030226 | A1 | | 2/2003 | Durham | |
| 2004/0163713 | A1 | | 8/2004 | Schulze | |
| 2012/0207632 | A1 | | 8/2012 | Usui | |
| 2012/0288382 | A1 | | 11/2012 | Yamaoka | |
| 2015/0204323 | A1 | | 7/2015 | Bouzidi | |
| 2017/0122302 | A1 | | 5/2017 | Bergman | |
| 2019/0003604 | A1 | * | 1/2019 | Mohamed | F04B 39/1066 |
| 2021/0079908 | A1 | | 3/2021 | Delmotte | |
| 2024/0125312 | A1 | * | 4/2024 | Hamacher | F25B 30/02 |

FOREIGN PATENT DOCUMENTS

| | | | | | |
|---|---|---|---|---|---|
| CN | 111022293 | A | | 4/2020 | |
| CN | 112796977 | A | | 5/2021 | |
| DE | 2510846 | A1 | | 9/1975 | |
| DE | 102011086476 | A1 | | 4/2013 | |
| DE | 102013002745 | A1 | | 8/2014 | |
| DE | 102021102648 | A1 | | 8/2022 | |
| EP | 0361927 | A1 | | 4/1990 | |
| EP | 0494236 | B1 | | 12/1995 | |
| FR | 1329662 | A | | 6/1963 | |
| GB | 2105787 | A | | 3/1983 | |
| GB | 2396667 | A | | 6/2004 | |
| GB | 2416196 | A | | 1/2006 | |
| GB | 2427660 | A | | 1/2007 | |
| SE | 354505 | B | * | 3/1973 | F04B 39/1073 |
| SU | 1627750 | A1 | | 2/1991 | |
| WO | 2006115348 | A1 | | 11/2006 | |
| WO | 2007128713 | A1 | | 11/2007 | |
| WO | 2010019582 | A2 | | 2/2010 | |
| WO | 2020064781 | A1 | | 4/2020 | |

OTHER PUBLICATIONS

International Preliminary Report on Patentability for PCT/NO2024/050025, dated Oct. 31, 2024.
Response to the Written Opinion for PCT/NO2024/050025, dated Oct. 16, 2024.
International Search Report and the Written Opinion for PCT/NO2024/050025, dated May 7, 2024.
International Search Report for PCT/NO2023/050026 dated Apr. 5, 2023.
Search Report for Norwegian Patent Application No. 20220232, dated Sep. 21, 2022.
Response to the Written Opinion for PCT/NO2023/050026, dated May 15, 2023.
Second Written Opinion for PCT/NO2023/050026, dated Aug. 10, 2023.
Response to the Written Opinion for PCT/NO2023/050026, dated Sep. 18, 2023.
Third Written Opinion for PCT/NO2023/050026, dated Apr. 10, 2024.
Response to the Written Opinion for PCT/NO2023/050026, dated May 7, 2024.
International Preliminary Report on Patentability for PCT/NO2023/050026, dated May 21, 2024.
Summons to Oral Proceedings Pursuant to Rule 115(1) EPC, dated Apr. 9, 2025.
Extended European Search Report for EP Application No. 25185017, dated Jun. 26, 2025.
Search Report for European Patent Application No. 25 22 5937, dated Jan. 22, 2026.
Office Action issued for Chinese Application No. 202480003604.3, dated Jul. 3, 2026.

* cited by examiner

PRIOR ART

PRIOR ART

2'2
2232
2222
202
2212
231'C
231'B
231'2

2222
2232
2'2
202

231'2
2212
231'C
231'B

PISTON COMPRESSOR VALVE ARRANGEMENT AND METHOD OF USE

CROSS-REFERENCE TO RELATED APPLICATIONS

This application is the U.S. national stage application of International Application No. PCT/NO2024/050025, filed Jan. 31, 2024, which international application was published on Aug. 15, 2024, as WO 2024/167414 in the English language. The International Application claims priority to Norwegian patent application Ser. No. 20230126, filed Feb. 8, 2023. The international application and Norwegian application are both incorporated herein by reference, in their entirety.

FIELD

The present invention relates to a valve arrangement for a piston compressor. More specifically, the invention relates to optimisation of the flow area in the suction and discharge valve sections of a piston compressor. The invention finds particular utility in the field of high-temperature heat pumps, but may be used in a piston compressor in any machine, not only high-temperature heat pumps.

BACKGROUND

Thermal machines such as heat pumps are known devices. Heat pumps are generally used to heat indoor spaces or supply hot water, steam or hot air to a user. Use of heat pumps is desirable as they provide for more sustainable heat than heating devices which use fossil fuels or direct electrical heating (e.g. by purely resistive heaters). Heat pumps transfer thermal energy from a low-temperature heat source to a high-temperature heat sink.

Many industrial processes require heat at high temperatures in the form of, for example, steam or hot water, which is extremely energy-intensive to produce, especially when primary energy sources are used. Examples of industries utilising heat at high temperatures include pulp and paper, food and beverages, chemicals, automotive, metal, plastic, engineering, textiles and wood. For example, in the food and beverage industry, heat at high temperatures is used in processes such as drying, evaporation, pasteurisation, sterilisation, boiling, distillation, blanching, scalding, concentrating, tempering and smoking, to name merely a handful of examples.

Industrial waste heat is often not utilised due to the low temperature of such waste heat, which is lower than the temperature required in many industrial processes. This waste heat can be upgraded using a high-temperature thermal machine such as a high-temperature heat pump, and thus reused, which has clear economic and environmental benefits.

Heat pumps, in both domestic and industrial settings, are known technology. The operating principles of heat pumps are described in German patent application DE102011086476A1 by Siemens AG. Conveniently, this patent application describes the principles of high-temperature heat pumps.

Heat pumps typically comprise an evaporation unit, a condensation unit, an expansion unit and an electrically driven compressor. The compressor is provided to compress a working fluid which circulates in a closed-loop working fluid circuit.

Working fluid is provided from the evaporation unit to the compressor in a gaseous state. The compressor typically sucks in this working fluid and compresses it to a relevant pressure, so that after the compression of the gaseous working fluid in the compressor, the temperature of the working fluid has increased to a level that is usable for a heat consumer.

The prior art utilises various forms of compressors for this application. For example, screw compressors, vane compressors, rotary piston compressors and reciprocating compressors are all used in the prior art.

Reciprocating compressors are well known and understood in many applications, not only in field of heat pump technology. Reciprocating compressors are well-suited to operate at temperatures above 100° C. due to their largely similar structure to internal combustion engines designed for temperatures up to several hundred degrees Celsius in the working chamber and lubricant temperatures up to about 100° C.

Reciprocating compressors have a basic operating principle of providing a moveable piston within a working chamber. The moveable piston sucks in the gaseous working fluid on a downward stroke. Working fluid is sucked into the working chamber through a suction valve section from a suction chamber. The working fluid is compressed and then discharged through discharge valve section to a discharge channel. This operation is very well understood to a person skilled in the art and forms the very elementary operating regime of well-known reciprocating compressors.

The piston within the piston compressor reciprocates on a cylinder longitudinal axis. In this connection, the piston travels upwards and downwards along the cylinder longitudinal axis, providing a reciprocating motion. In the context of the present disclosure, the compressor described is referred to as a piston compressor.

It will be understood that the piston compressor is most commonly combined with other components when used in a heat pump system. For example, the piston compressor is typically combined with a drive unit which in most cases is an electrically powered motor. Further, the piston compressor is typically also combined with a lubricant reservoir to continually provide lubricant to the piston compressor in use. Lubricant is typically required to lubricate components of the piston compressor such as the piston itself and/or the bearings, cylinders etc.

The most basic design of piston compressors provides a working chamber with a flat working chamber head section. The suction valve section and discharge valve sections are provided at the flat working chamber head section and are provided perpendicular to the cylinder longitudinal axis, as will be described in more detail later.

Common to all compressor types, is that they operate on a working fluid, also commonly referred to as a refrigerant, or simply gas. In some examples, the working fluid may be a condensable gas. In other examples the working fluid never changes phase, and hence the working fluid is only operated in a gaseous state. In further examples there are combinations of the two aforementioned modes. Throughout the present disclosure, any working fluid in any phase, including but not limited to: partly liquid; gaseous; and supercritical is intended when referring to the working fluid.

The performance of heat pump compressors, and more specifically gas/vapor compressors, is mainly a result of the three characteristics:

1. Mechanical efficiency
2. Volumetric efficiency
3. Isentropic efficiency

Mechanical efficiency is primarily a consequence of internal, mechanical friction, or rather, a lack thereof. Volumetric efficiency is primarily a consequence of the internal, so-called dead volume (also called clearance volume, in the compressor's working chamber, i.e. the minimum achievable internal volume in the cylinder of a working chamber of a compressor during compression). Lastly, the isentropic efficiency is mainly a consequence of the effectiveness of the gas exchange processes, which include the suction process and the discharge process.

Beyond this, there are further factors that affect the aforementioned characteristics, such as thermal leakage/undesired heat exchange through internal surfaces, e.g., a cylinder wall, which affects the isentropic efficiency, and gas leakage past sealing elements etc., which affects the isentropic efficiency as well as the volumetric efficiency.

Compressor operation consists of four principal processes (or steps) that are performed cyclically. For piston compressors, these are performed once per revolution of the crankshaft (or other piston-driving means, such as a swashplate):

1. A suction process.
2. A compression process.
3. A discharge process.
4. A re-expansion process.

The suction and discharge processes comprise the gas exchange processes, during which a working fluid, normally in its gaseous/vapor form, is either sucked into or discharged out of the cylinder. The gas exchange processes are governed by the suction and discharge valves: the suction valve controls the inflow of new, uncompressed gas into the cylinder during the suction process, while the discharge valve controls the outflow of compressed gas during the discharge process.

Compressors can have one or more cylinders, and each cylinder has its corresponding set of suction and discharge valves, and the suction/discharge valves can each in turn also consist of multiple valves working in parallel, as is quite common. Throughout the present disclosure, reference is made to single cylinders (and corresponding pistons, suction and discharge valve sections etc) for the sake of clarity and brevity. It will be understood that any single cylinder may be a single cylinder within a system of multiple cylinders (and corresponding pistons, suction and discharge valve sections etc).

In conventional compressor designs, the suction/discharge valves are often in the form of a so-called reed valve, which constitutes a simple, yet effective principal component for many compressor applications.

Reed valves in principle comprise at least a valve plate or a valve port section with a reed element (also called a reed valve blade) and a retainer (sometimes also called a stop plate). The reed element is usually in the form of a thin metal sheet, which sometimes is also made from a spring material, with the reed element performing the actual opening and closing of the valve, by covering or uncovering port openings, slots or similar in the valve plate or valve port section. Sometimes an independent spring element is provided, which is made to continuously push and thus provides a force on the reed element in the closing direction. This is to aid in closing of the valve, and to prevent flow through the valve when it should otherwise be closed. The retainer can typically be a curved, relatively stiff sheet metal piece, which is shaped to let the reed element "roll" against its curved surface, as to limit the movement of the reed element and thus to guide it, and also to prevent damage that could otherwise be caused by excessive bending during operation. Other times the retainer is in the form of a retainer plate, which is fixed at a certain distance from the reed element, and often with a spring element in between. The principal function is the same, but the designs can vary.

Reed valves are passively operated, meaning that they open and close only due to a pressure differential (or lack thereof) across the reed element in the opening direction.

Reed valves are compact and lightweight, their design is generally simple, and they provide for easy and affordable manufacturing. However, reed valves have some drawbacks for certain applications: It is difficult to design reed valves with as effective flow areas as for certain other valve types, and it is also difficult to design a compressor with a very low dead volume, especially when the suction valve is of the reed type, and a corresponding suction valve retainer (stopper plate) is provided, since this will then cause some non-displaceable dead volume to be formed. The consequence of this is that compressors equipped with reed valves usually have higher dead volumes and smaller effective flow areas than necessary. This in turn results in lower volumetric and isentropic efficiencies, respectively.

One area where improvements can be made in piston compressors is in the arrangement of the suction and discharge valve sections. The flow through these valve sections can be optimised in different ways. One such way is to increase the available area for each of the valve sections. This has been provided in prior art attempts to optimise performance. More specifically, attempts have been made to optimise the performance by angling the suction and discharge valves out of 90-degree arrangement with respect to the cylinder axis.

That is to say, the valve sections form a wedge-like cross-section at the head section. This provides an increased surface area for the valve sections when compared with the flat head section previously described.

Chinese utility model document CN201739117U describes an acetylene compressor utilising a wedge-like cross-section.

It is difficult to further optimise the arrangement of the valve sections to further improve the performance of the piston compressor. The optimisation of performance is based on many different parameters which are affected by changes to the head section design. It is possible to greatly increase the surface area of the suction and discharge valve sections, however this typically results in a greatly increased dead volume. In this connection, it is highly desirable to increase the suction and discharge valve areas without greatly increasing the dead volume, thereby providing an optimised piston compressor valve arrangement.

Furthermore, the configuration of the particular valves used in the suction and discharge valve sections can have a great impact on the performance of the piston compressor. For example, particular valves used may increase the dead volume in the head section, thereby impacting the performance of the piston compressor.

The piston compressor may therefore be said to be a complex system, whereby optimisation of the performance is dependent on many interrelated components and design considerations.

It is therefore highly desirable to provide a piston compressor valve arrangement which provides optimisation of the performance of the piston compressor rather than merely the optimisation of one parameter at the expense of another.

Patent document SE354505B discloses a piston compressor and in particular an arrangement of the pressure valves in such a compressor. The compressor comprises a cylinder in which a piston moves up and down through the action of a crankshaft. The cylinder is provided with a valve plate. In the sides of the cylinder head intake ducts are arranged and covered by expansion valve flaps.

Patent document 231059A discloses a vertically-situated pump barrel or cylinder having the lower section of its interior made in the form of the frustum of a cone or pyramid, with its lower end closed, and having a series of openings through its inclined sides arranged at intervals around its circumference, and adapted to be covered each by one or more valves arranged to rest upon inclined seats within said pump-barrel and to open inward.

Patent document US2004/163713A discloses a suction reed valve including a central ring shaped body having a pair of tabs extending radially outward. One of the pair of tabs is fixed to a valve plate and the other tab is free to move. A necked down region is located between the fixed tab and the central ring shaped body to facilitate the bending/deflection of the suction reed valve.

Patent document US2015/0204323A1 discloses a compressor cylinder head with a cylinder head housing and at least one pressure valve. The pressure valve has an associated pressure valve channel in the cylinder head housing. The pressure valve channel connects a compression chamber arranged below the compressor cylinder head to a pressure chamber inside the compressor cylinder head. Further, the compressor cylinder head has one or more channel portions with a first coolant channel system inside the cylinder head housing, which can be filled with a coolant that flows around the pressure chamber. Via a casting method, the cylinder head housing is produced integrally with the first coolant channel system arranged therein, and further coolant channels are arranged on either side of the at least one pressure valve channel.

U.S. Pat. No. 2,934,083 discloses a check valve of the multiple passageway type for installation in valve housings at the suction and discharge ports of a compressor chamber to direct the flow of a gaseous medium being compressed into and out of said compressor chamber comprising, a truncated pyramidal body portion defining a hollow chamber, said body portion being a plurality of flat plate sections welded together and a closure at one end of said body portion, the opposite end of said body portion being open, said flat plate sections having a width which tapers inwardly toward said closure each of said flat plate sections having at least one valved passageway therethrough, a reed having a free end and a fixed end for valving said passageway, said fixed end being attached to said body portion near said passageway, a reed guard overlying said reed and limiting the movement of said reed away from said passageway, said guard having one end fixedly attached with respect to said body portion and in alignment with the attachment of said reed and the opposite end of said reed guard overlying the free end of said reed, said reed guard being biased away from said passageway, an outwardly directed offset portion in said reed guard adjacent said fixedly attached end of said reed guard, and an extendable limit stop operatively coupled with said opposite end of said reed guard for spacing said reed guard distances selected at will from said passageway to limit the outward flexing of said reed.

U.S. Pat. No. 2,025,240 discloses a refrigerant compressor, the combination of a compressor having a cylinder block and a crank case, a cylinder head attachable to the cylinder block and forming a discharge compartment, a valve plate having a chamber for expanded refrigerant, a valve controlled port in the plate connecting the chamber to the cylinder, a valve controlled discharge port in the plate connecting the cylinder with the discharge compartment, and a drain conduit connecting the said chamber with the crank case of a compressor.

At least one aim of the invention is to obviate or at least mitigate one or more drawbacks of prior art.

SUMMARY

According to a first aspect of the invention, there is provided a valve arrangement for a piston compressor, the valve arrangement comprising: a suction valve section; and a discharge valve section; wherein the suction valve section and discharge valve section together form a working chamber head section, and the suction valve section has a frustopyramidal form.

The suction valve section may comprise at least a first self-actuated check valve.

The frustopyramidal form of the suction valve section may comprise a plurality of lateral faces, wherein the first self-actuated check valve is located on a first lateral face of the plurality of lateral faces of the suction valve section.

The first self-actuated check valve may comprise a first reed suction valve.

The suction valve section may comprise at least a first suction port configured to provide fluid communication through the suction valve section; and the first reed suction valve comprises at least a first finger blade arranged to open and close the first suction port.

The suction valve section may comprise a second suction port configured to provide fluid communication through the suction valve section; and the first finger blade is arranged to open and close the second suction port.

The suction valve section may comprise a second suction port configured to provide fluid communication through the suction valve section; and the first reed suction valve comprises a second finger blade arranged to open and close the second suction port.

The first and second finger blades may be unitary.

The first and second finger blades may be non-unitary.

The valve arrangement may further comprise a first finger catch configured to arrest the movement of the first finger blade.

The valve arrangement may further comprise a second finger catch configured to arrest the movement of the second finger blade.

The discharge valve section may comprise a first discharge port configured to provide fluid communication through the discharge valve section and to arrest the movement of the first finger blade.

The discharge valve section may comprise a second discharge port configured to provide fluid communication through the discharge valve section and to arrest the movement of the first finger blade and/or the second finger blade.

The valve arrangement may further comprise a second self-actuated check valve located on a second lateral face of the plurality of lateral faces of the suction valve section.

The second self-actuated check valve may comprise a second reed suction valve.

The suction valve section may comprise at least a third suction port configured to provide fluid communication through the suction valve section; and the second reed suction valve comprises at least a third finger blade arranged to open and close the third suction port.

The suction valve section may comprise a fourth suction port configured to provide fluid communication through the suction valve section; and the third finger blade is arranged to open and close the fourth suction port.

The suction valve section may comprise a fourth suction port configured to provide fluid communication through the suction valve section; and the second reed suction valve comprises a fourth finger blade arranged to open and close the fourth suction port.

The first and second finger blades may be unitary.

The first and second finger blades may be non-unitary.

The valve arrangement may have a central axis configured to be aligned with a longitudinal axis of the cylinder of the piston compressor in use, wherein the discharge valve section is configured perpendicularly to the central axis, such that in use the discharge valve section is at or substantially at 90 degrees to the longitudinal axis of the cylinder.

According to a second aspect of the invention, there is provided a valve arrangement for a piston compressor, the valve arrangement comprising: a suction valve section; and a discharge valve section; wherein the suction valve section and discharge valve section together form a working chamber head section, and the suction valve section has a substantially frustoconical form comprising at least a first flat lateral surface.

The suction valve section may comprise at least a first self-actuated check valve located on the first flat lateral surface.

The first self-actuated check valve may comprise a first reed suction valve.

The suction valve section may comprise at least a first suction port configured to provide fluid communication through the suction valve section; and the first reed suction valve comprises at least a first finger blade arranged to open and close the first suction port.

The valve arrangement may further comprise a first finger catch configured to arrest the movement of the first finger blade.

The discharge valve section may comprise a first discharge port configured to provide fluid communication through the discharge valve section and to arrest the movement of the first finger blade.

The valve arrangement may have a central axis configured to be aligned with a longitudinal axis of the cylinder of the piston compressor in use, wherein the discharge valve section is configured perpendicularly to the central axis, such that in use the discharge valve section is at or substantially at 90 degrees to the longitudinal axis of the cylinder.

According to a third aspect of the invention, there is provided a valve arrangement for a piston compressor, the valve arrangement comprising: a suction valve section; and a discharge valve section; wherein the suction valve section and discharge valve section together form a working chamber head section, and the discharge valve section has a frustopyramidal form.

According to a fourth aspect of the invention, there is provided a valve arrangement for a piston compressor, the valve arrangement comprising: a suction valve section; and a discharge valve section; wherein the suction valve section and discharge valve section together form a working chamber head section, and the discharge valve section has a substantially frustoconical form comprising at least a first flat lateral surface.

According to a fifth aspect of the invention, there is provided a piston compressor comprising: a cylinder comprising a longitudinal axis; a piston mounted in the cylinder and linearly moveable along the longitudinal axis; and a valve arrangement according to any of the first to fourth aspects the invention.

The piston may comprise a piston head section registered with the working chamber head section.

According to a sixth aspect of the invention, there is provided a method of optimising fluid flow through a valve arrangement, comprising the steps of: providing a valve arrangement according to any of the first to fourth aspects of the invention; sucking a working fluid through the suction valve section; and discharging the working fluid through the discharge valve section.

According to a seventh aspect of the invention, there is provided a method of operating a piston compressor, comprising the steps of: providing a piston compressor according to the fifth aspect of the invention; sucking a working fluid through the suction valve section into the cylinder; compressing the working fluid by linearly moving the piston along the longitudinal axis; and discharging the working fluid out of the cylinder through the discharge valve section.

BRIEF DESCRIPTION OF THE DRAWINGS

Embodiments of the invention will now be described with reference to the following drawings, in which.

Figure 1:
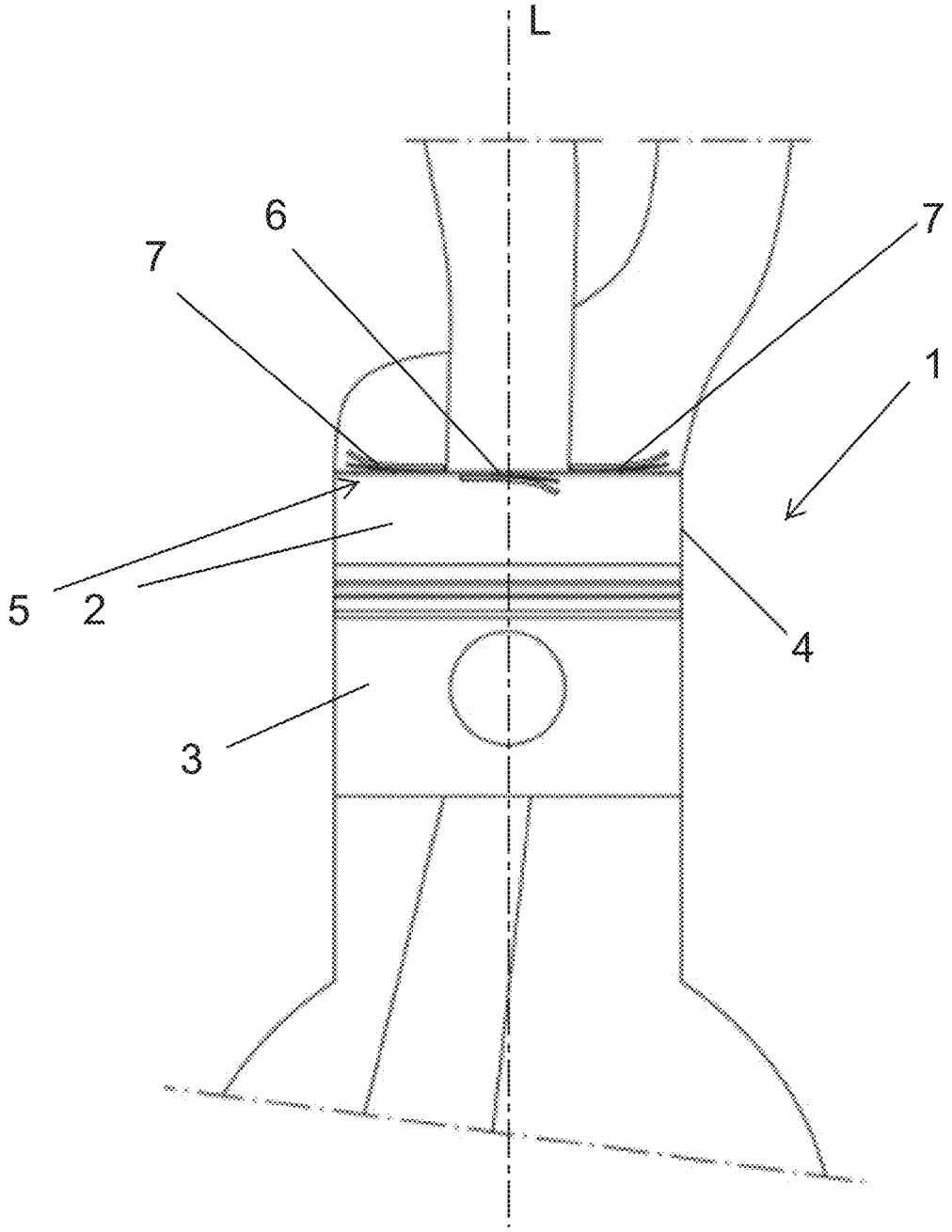
FIG. 1 shows a cross-sectional view through a prior art piston compressor.

It will be appreciated that many of the basic components of the piston compressor have not been shown in the drawings in the interest of brevity and clarity. Some of the basic components missing in the drawings are major components of the piston compressor, such as the piston and the cylinder. It will be understood that these are missing from the drawings as the exact configuration of the missing components is not important for the invention presently described, which relates to the valve arrangement.

DETAILED DESCRIPTION OF THE DRAWINGS

Throughout the present description, reference is made to a truncated pyramid, truncated pyramidal shape, truncated pyramidal form, frustopyramidal form, truncated cone, truncated conical shape, truncated conical form, frustoconical form etc. In geometry, a pyramid is a polyhedron formed by connecting a polygonal base and a point called the apex. Each base edge and apex form a triangle, called a lateral face.

A regular pyramid has a regular polygon base. An irregular pyramid has an irregular polygon base. A triangular based pyramid is often called a tetrahedron. However, in the present disclosure, pyramids with triangular bases are included within the general term pyramids, rather than being separately referred to as tetrahedrons. In this connection, the pyramids, and further shapes derived from pyramids discussed herein, may have polygonal bases comprising three or more edges and three or more lateral faces. As will be discussed later, the number of lateral faces is not critical to the invention.

Still referring to geometry in general, truncation is an operation in any dimension that cuts polytope vertices, creating a new facet in place of each vertex. Said more simply, a truncated shape is that shape with one of its parts or corners cut off.

As previously mentioned, reference is made throughout the present disclosure to a truncated pyramid. The described truncated pyramid may have a large number of lateral faces such that it looks substantially like a truncated cone. As will be described in more detail later, even if there are many lateral faces making up the truncated pyramid, each lateral face has a substantially flat surface, as will be described later.

A cone is a geometric shape that tapers smoothly from a flat base to a point called the apex. Most commonly, the base of cones is perfectly circular. However, the base need not be a perfect circle to make a cone in the present context. In common usage, cones are typically right circular, whereby the base is a circle and the axis of the cone passes through the centre of the base at right angles to its plane. This can be contrasted with oblique cones, whereby the axis of the cone passes through the centre of the base non-perpendicularly. As previously discussed, the base may be any shape and the apex may lie anywhere in a cone. A cone with a polygonal base is called a pyramid, as previously explained.

A frustum in geometry is a three-dimensional geometric shape formed by the volume between two parallel planes and a polyhedron, often a pyramid or cone. Therefore, in geometry, a truncated conical shape is the same as a frustoconical shape and a truncated pyramidal shape is the same as a frustopyramidal shape.

It will be understood that cones and pyramids may be solid or hollow. In the present context, reference is mostly made to valve sections being of frustoconical form or frustopyramidal form. It will become apparent that the valve sections within piston compressors cannot be solid pyramidal or solid conical shapes. Instead, as will be shown in the forthcoming description and with reference to the Figures, the valve sections are shell-like hollow structures. The use of "frusto" as a prefix to the main shape indication may generally be regarded as a removal of the requirement that the shape has an apex. In this connection, throughout the present disclosure, frustoconical and frustopyramidal forms generally refer to frustocones and frustopyramids which are open at their top and bottom truncations, thereby allowing working fluid flow through their top and bottom truncations.

Although it may often be convenient to provide frustoconical and frustopyramidal forms between two parallel planes, the terms frustopyramidal and frustoconical are not restricted to truncations between two parallel planes. Instead, it will be understood that the truncations may be formed between two non-parallel planes.

Furthermore, solid cones or pyramids would block the aforementioned stroking of the piston within the cylinder at the head section of the cylinder.

FIG. 1 shows a prior art compressor 1 in the form of a piston compressor which utilises a condensable working fluid. The compressor 1 comprises a working chamber 2 and a reciprocating piston 3 arranged inside a cylinder 4. The working chamber 2 is defined by the piston 3, cylinder 4 and a working chamber head section 5. The working chamber 2 is for compression of the compressible working fluid therein. As can be seen in FIG. 1, the working chamber head section 5 is formed of a suction valve section 6 and a discharge valve section 7. The working chamber head section 5 is substantially flat. That is to say, the suction valve section 6 and discharge valve section 7 are arranged such that they substantially share the same plane and are not angled with respect to each other, as can clearly be seen in FIG. 1. Still referring to FIG. 1, the suction valve section and discharge valve section are provided perpendicular to the cylinder longitudinal axis L of the cylinder 4. The available flow area through the suction valve section and discharge valve section in such an arrangement is relatively low. As previously discussed, the reduced available flow area has a detrimental impact on overall performance of the compressor.

Figure 2A:
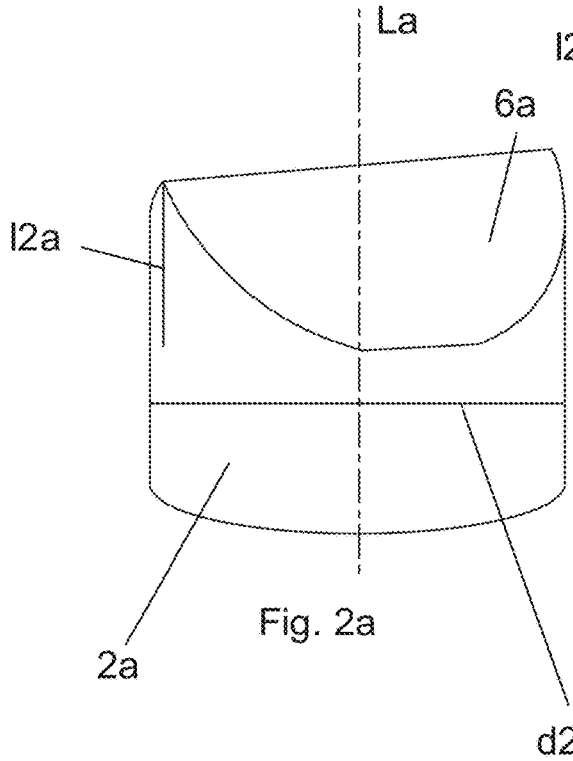
FIG. 2*a* shows a computer aided design model of a first modified working chamber with first and second angled surfaces.
Figure 2B:
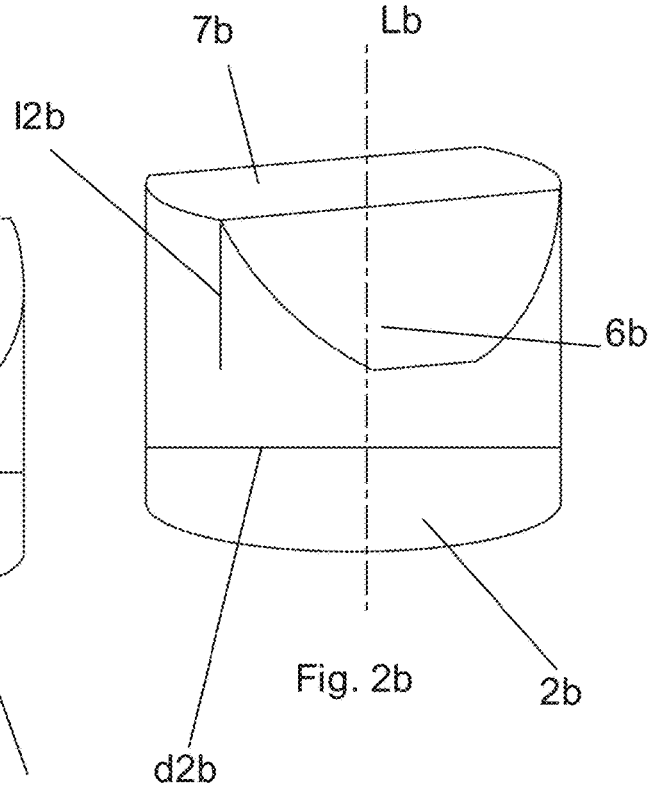
FIG. 2*b* shows a computer aided design model of a second modified working chamber with first and second angled surfaces and a third surface perpendicular to the cylinder axis.

Referring now to FIGS. 2*a* and 2*b*, there are shown computer aided design (CAD) models of working chamber volumes, provided purely to aid the explanation of the invention which will be described in due course. FIGS. 2*a* and 2*b* are marked 'PRIOR ART' because they are models based on well-known valve arrangement designs. The models are provided as basic modified working chamber volumes for the purposes of the forthcoming explanation of flow through the top sections of the working chambers.

Referring firstly to FIG. 2*a*, there is provided a first working chamber volume 2*a*. There is also provided a suction valve section 6*a* and a discharge valve section (not visible in FIG. 2*a*). The suction 6*a* and discharge valve sections are out of 90-degree arrangement with respect to the cylinder axis La, thereby providing a wedge-like cross-section at the head section shown.

The exemplary first working chamber volume 2*a* has a diameter d2*a* of 210 mm and the suction valve section 6*a* and discharge valve section cover 75 mm in elevation in the longitudinal direction l2*a* from the top of the head section. The available area for the suction valve section 6*a* is around 210 $cm^2$ and the available area for the discharge valve section is around 210 $cm^2$. Therefore, the total available area for the suction and discharge valve sections is around 420 $cm^2$.

Referring now to FIG. 2*b*, there is provided a second working chamber volume 2*b*. There is also provided a suction valve section 6*b* which is partially provided on the visible side shown in FIG. 2*b* and partially provided in the same position on the non-visible side. The is also provided a discharge valve section 7*b*. The suction valve section 6*b* is out of 90-degree arrangement with respect to the cylinder axis Lb and the discharge valve section 7*b* is provided at 90 degrees to the cylinder axis.

The cylinder 2*b* has a diameter d2*b* of 210 mm and the suction valve section 6*b* covers 75 mm in elevation in the longitudinal direction l2*b* from the top of the head section. The available area for the suction valve section 6*b* is around 130 $cm^2$ on either side, therefore the total available area for the suction valve section 6*b* is around 260 $cm^2$ and the available area for the discharge valve section is around 200 $cm^2$. Therefore, the total available area for the suction and discharge valve sections is around 460 $cm^2$.

Figure 2C:
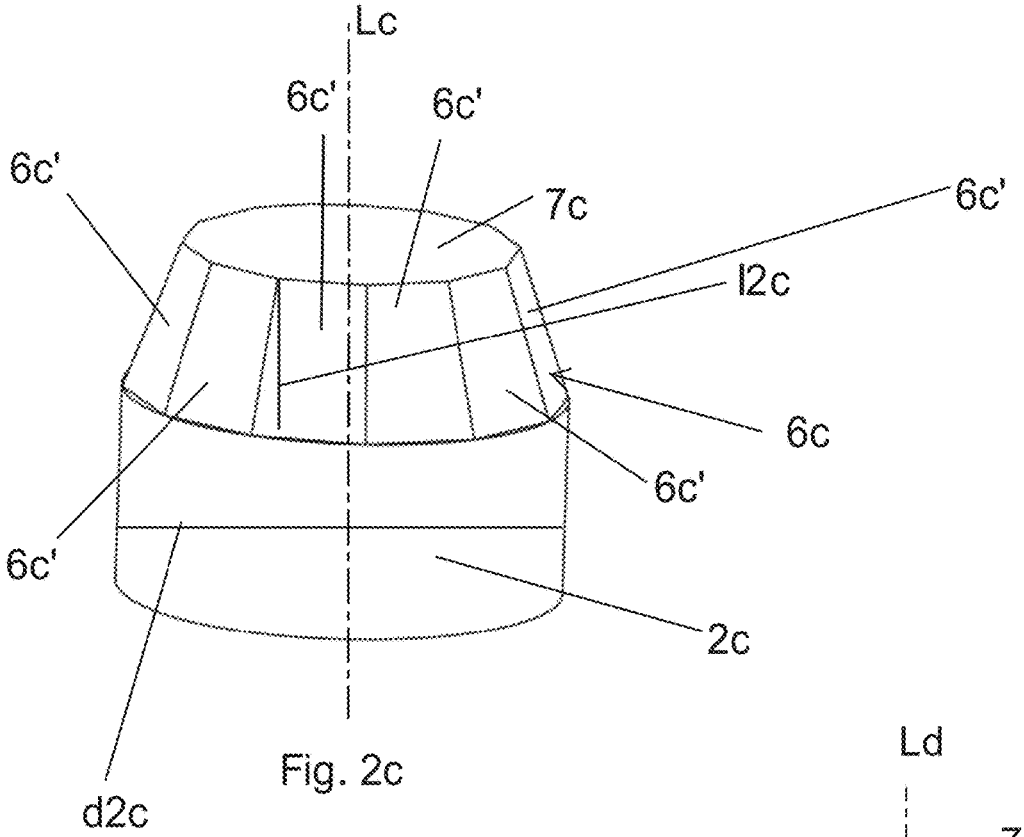
FIG. 2*c* shows a computer aided design model of a third modified working chamber with a truncated tapering form.
Figure 2D:
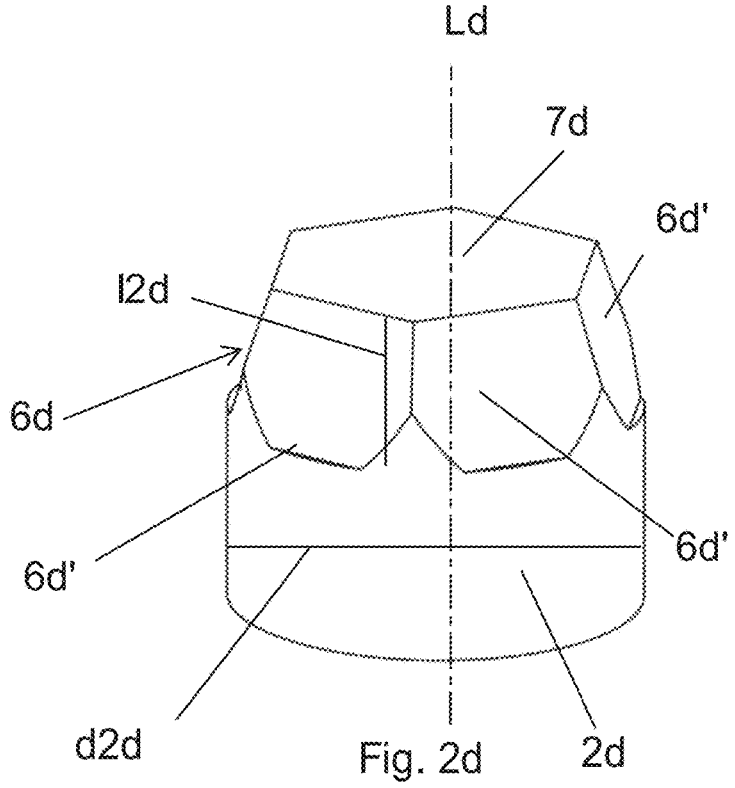
FIG. 2*d* shows a computer aided design model of a fourth modified working chamber with a frustopyramidal form.

Referring now to FIGS. 2*c* and 2*d*, there are shown CAD models of working chamber volumes, provided purely to aid the explanation of the invention. The models are provided as basic modified working chamber volumes for the purposes of the forthcoming explanation of flow through the valve arrangement of the invention.

Referring now to FIG. 2*c*, there is provided a third working chamber volume 2*c*. There is also provided a suction valve section 6*c* which is partially provided on the visible side shown in FIG. 2*c* and partially provided in the same manner on the non-visible side. That is to say, the suction valve section 6*c* continues around the circumference of the working chamber volume 2*c* in the non-visible part. There is also provided a discharge valve section 7*c*. The suction valve section 6*c* is out of 90-degree arrangement with respect to the cylinder axis Lc and the discharge valve section 7*b* is provided at 90 degrees to the cylinder axis.

The cylinder 2*c* has a diameter d2*c* of 210 mm and the suction valve section 6*c* covers 75 mm in elevation in the longitudinal direction l2*c* from the top of the head section. The suction valve section 6*c* has a frustopyramidal form comprising a plurality of lateral faces 6*c*'. Each of the plurality of lateral faces 6*c*' is a substantially flat surface which tapers towards the top. In this connection, the suction valve section 6*c* can be said to have a frustopyramidal form as the plurality of lateral faces 6*c*' together form a pyramid which has been truncated.

By providing this frustopyramidal form, the available area for the suction valve section 6*c* is greatly improved. The available area for the suction valve section is around 38 $cm^2$ on each lateral face 6*c*'. In the presently described example, there is provided twelve lateral faces. Therefore the total available area for the suction valve section 6*c* is around 450 $cm^2$. The discharge valve section 7*c* is provided as a flat area at 90 degrees to the cylinder longitudinal axis. As will be explained later, it is not essential that the discharge valve section 7*c* is provided at 90 degrees to the cylinder longitudinal axis, and this is instead presented here merely as an example. The available area for the discharge valve section in the current example is around 200 $cm^2$. Therefore, the total available area for the suction and discharge valve sections is around 650 $cm^2$.

Referring now to FIG. 2*d*, there is provided a fourth working chamber volume 2*d*. There is also provided a suction valve section 6*d* which is partially provided on the visible side shown in FIG. 2*d* and partially provided in the same manner on the non-visible side. That is to say, the suction valve section 6*d* continues around the circumference of the working chamber volume 2*d* in the non-visible part. The is also provided a discharge valve section 7*d*. The suction valve section 6*d* is out of 90-degree arrangement with respect to the cylinder axis Ld and the discharge valve section 7*d* is provided at 90 degrees to the cylinder axis Ld. It is again reiterated that the discharge valve section 7*d* need not be at 90 degrees to the cylinder axis Ld in other examples, this is merely provided as an exemplary angle in the present example.

The cylinder 2*d* has a diameter d2*d* of 210 mm and the suction valve section 6*d* covers 75 mm in elevation in the longitudinal direction l2*d* from the top of the head section. The suction valve section 6*d* has a frustopyramidal form comprising a plurality of lateral faces 6*d*'. Each of the plurality of lateral faces 6*d*' is a substantially flat surface which tapers towards the top. In this connection, the suction valve section 6*d* can be said to have a frustopyramidal form as the plurality of lateral faces 6*d*' together form a pyramid which has been truncated. It will be understood that frustopyramidal and frustoconical are intended to mean substantially frustopyramidal and substantially frustoconical respectively, and that non-perfect frustopyramids and non-perfect frustocones are included within the terms frustopyramidal and frustoconical. The frustopyramids and frustocones may be imperfect for myriad design reasons, such as to aid the positioning of valves, machining of valve sections, sealing of valves and/or assembly, to name just a number of examples.

In the previously described example shown in FIG. 2*c*, each lateral face 6*c*' is provided as a quadrilateral. In the example described with reference to FIG. 2*d*, the lateral faces 6*d*' are close to hexagons (with two of the sides being elliptical arcs). It will be understood that such lateral faces 6*d*' arranged together as described still provide a frustopyramidal form to the suction valve section 6*d*.

By providing this frustopyramidal form, the available area for the suction valve section 6*d* is greatly improved with respect to the examples shown in FIGS. 2*a* and 2*b*. The available area for the suction valve section is around 70 around $cm^2$ on each lateral face 6*d*'. In the presently described example, there is provided six lateral faces. Therefore the total available area for the suction valve section 6*d* is around 420 $cm^2$. The discharge valve section 7*d* is provided as a flat area at 90 degrees to the cylinder longitudinal axis. The available area for the discharge valve section is around 200 $cm^2$. Therefore, the total available area for the suction and discharge valve sections is 620 $cm^2$.

Although in the presently described frustopyramidal forms shown in FIGS. 2*c* and 2*d*, six and twelve lateral faces are provided, it will be understood that any number of lateral faces equal to or greater than three may be provided in other examples.

The use of a frustopyramidal suction valve section in a valve arrangement for a piston compressor is now described with reference to FIGS. 3 and 4.

Figure 3:
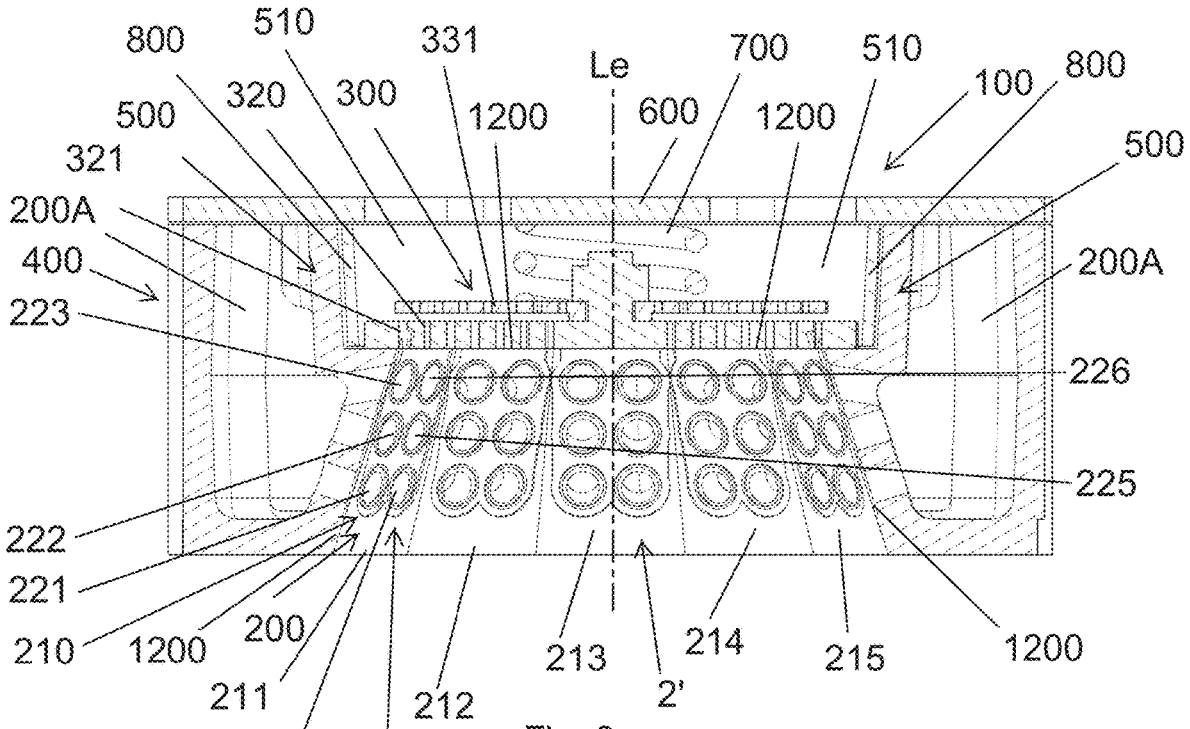
FIG. 3 shows a cross-sectional view through a cylinder head comprising a piston compressor valve arrangement with the suction valves not shown.

Referring to FIG. 3, there is shown a valve arrangement 100 for a piston compressor (not shown). The valve arrangement 100 comprises main components of a suction valve section 200 and a discharge valve section 300. The valve arrangement 100 is shown as it is utilised in a cylinder head 400 of a piston compressor. It will be understood that the suction valve section 200 is to allow working fluid to be sucked into a working chamber 2' (only partially shown in FIG. 3) of the piston compressor in use. Similarly, the discharge valve section 300 is to allow working fluid to be discharged from the working chamber 2' of the piston compressor in use.

The suction valve section 200 and discharge valve section 300 together form a working chamber head section 1200. That is to say, the suction valve section 200 and discharge valve section 300 together form the upper portion of the working chamber 2' of the piston compressor when the valve arrangement 100 is assembled in use in a piston compressor.

The arrangement of the suction valve section 200 is to provide improved performance of the compressor by improving the fluid flow through the suction valve section 200 without impacting the dead volume substantially, which as previously explained has a great impact on the overall performance.

In this connection, the suction valve section 200 comprises a frustopyramidal form comprising a plurality of lateral faces 210 comprising first 211, second 212, third 213, fourth 214, fifth 215 and further lateral faces not visible in the cross-sectional view shown in FIG. 3.

Although not shown in the Figures, it will be understood that the piston in the piston compressor is able to stroke unobstructed into the working chamber head section from below. In this connection, a piston used with the presently described valve arrangement may optimally be configured to register with the shape of the described valve arrangement. That is to say, since the suction valve section 200 comprises a frustopyramidal form, the piston may also comprise a frustopyramidal form registered with the form of the suction valve section 200. Said another way, the piston crown may be formed in a complementary shape to that of the working chamber head section 1200.

Each of the plurality of lateral faces 210 is substantially flat such that valves requiring flat surfaces can be located on one or more of the lateral faces 210.

Still referring to FIG. 3, the first lateral face 211 comprises a plurality of suction ports 220 comprising first 221, second 222, third 223, fourth 224, fifth 225 and sixth 226 suction ports. The suction ports 220 are configured to provide fluid communication through the suction valve section 200 such that working fluid can be sucked through the suction ports 220 into the working chamber in use.

Figure 4:
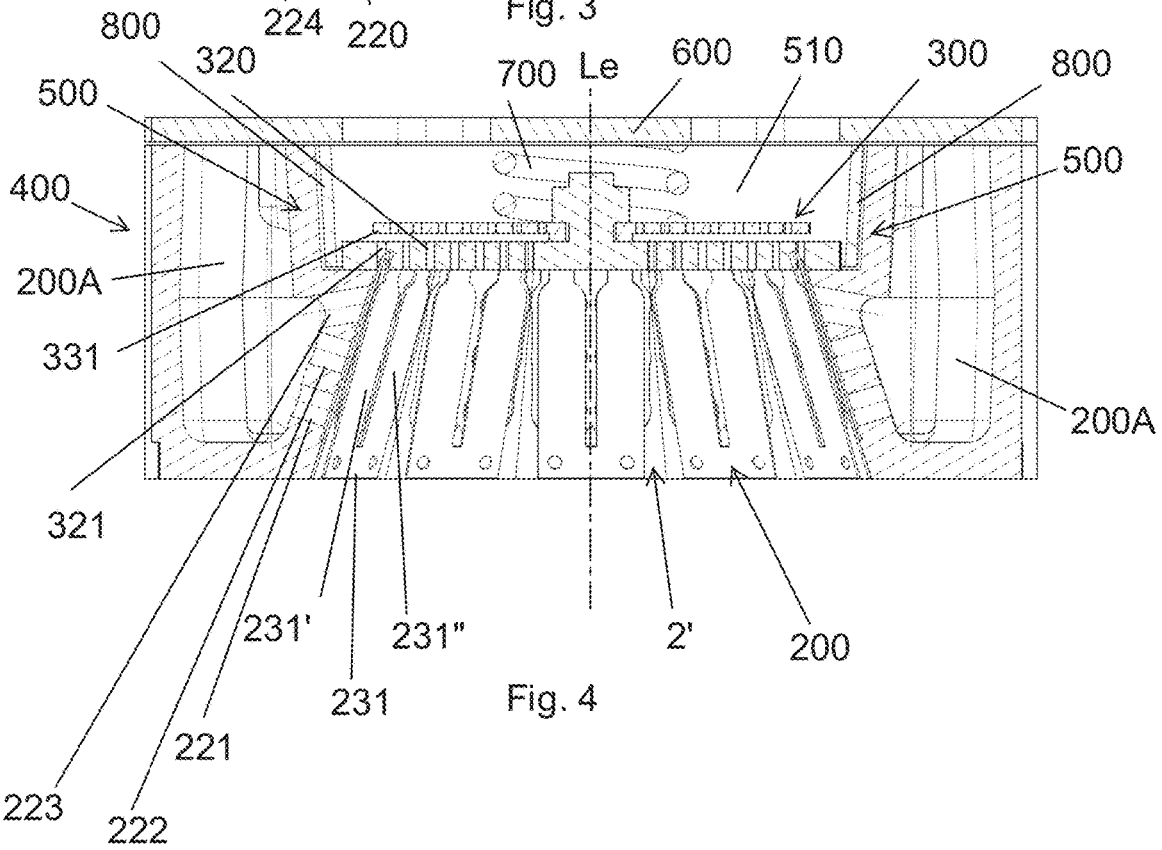
FIG. 4 shows the same cross-sectional view through the cylinder head shown in FIG. 3, with the suction valves shown.

As shown in FIG. 4, the suction valve section 200 comprises a first self-actuated check valve in the form of a first reed valve 231. The first reed valve 231 comprises first 231' and second 231" finger blades arranged to open and close the suction ports 220 (not visible in FIG. 4), as is now explained.

The first finger blade 231' is arranged to open and close the first 221, second 222 and third 223 suction ports and the second finger blade 231" is arranged to open and close the fourth 224, fifth 225 and sixth 226 suction ports. In the presently described example, the first 231' and second 231" finger blades are unitary. This provides a larger first reed valve 231 and allows for easier and faster production and assembly when compared with the first 231' and second 231" finger blades being provided separately. However, in some alternative examples (not shown), the first 231' and second 231" finger blades are provided separately, i.e. non-unitarily.

The arrangement shown comprising three ports 221, 222, 223 arranged with an associated first finger blade 231' and another three ports 224, 225, 226 arranged with an associated second finger blade 231" is merely an example only. In alternative examples, there may be a lesser or greater number of ports and/or a lesser or greater number of finger blades. For example, there may be one finger blade arranged to open and close six ports. In some examples the finger blade may be arranged to open and close a square or rectangular array of ports, rather than a line of ports as in the presently described example.

As previously explained, reed valves require some form of retainer, typically provided in the form of a stop plate. The retainer is typically a curved, relatively stiff sheet metal piece, which is shaped to let the reed element "roll" against its curved surface, as to limit the movement of the reed element and thus to guide it, and also to prevent damage that could otherwise be caused by excessive bending during operation. As previously explained, other prior art retainers are in the form of a retainer plates, which are fixed at a certain distance from the reed element, and often with a spring element in between the plate and the reed element. The reed elements in the presently described example are the finger blades 231', 231" which are retained without the use of a separate retainer, as in the prior art, as will be explained.

Figure 5:
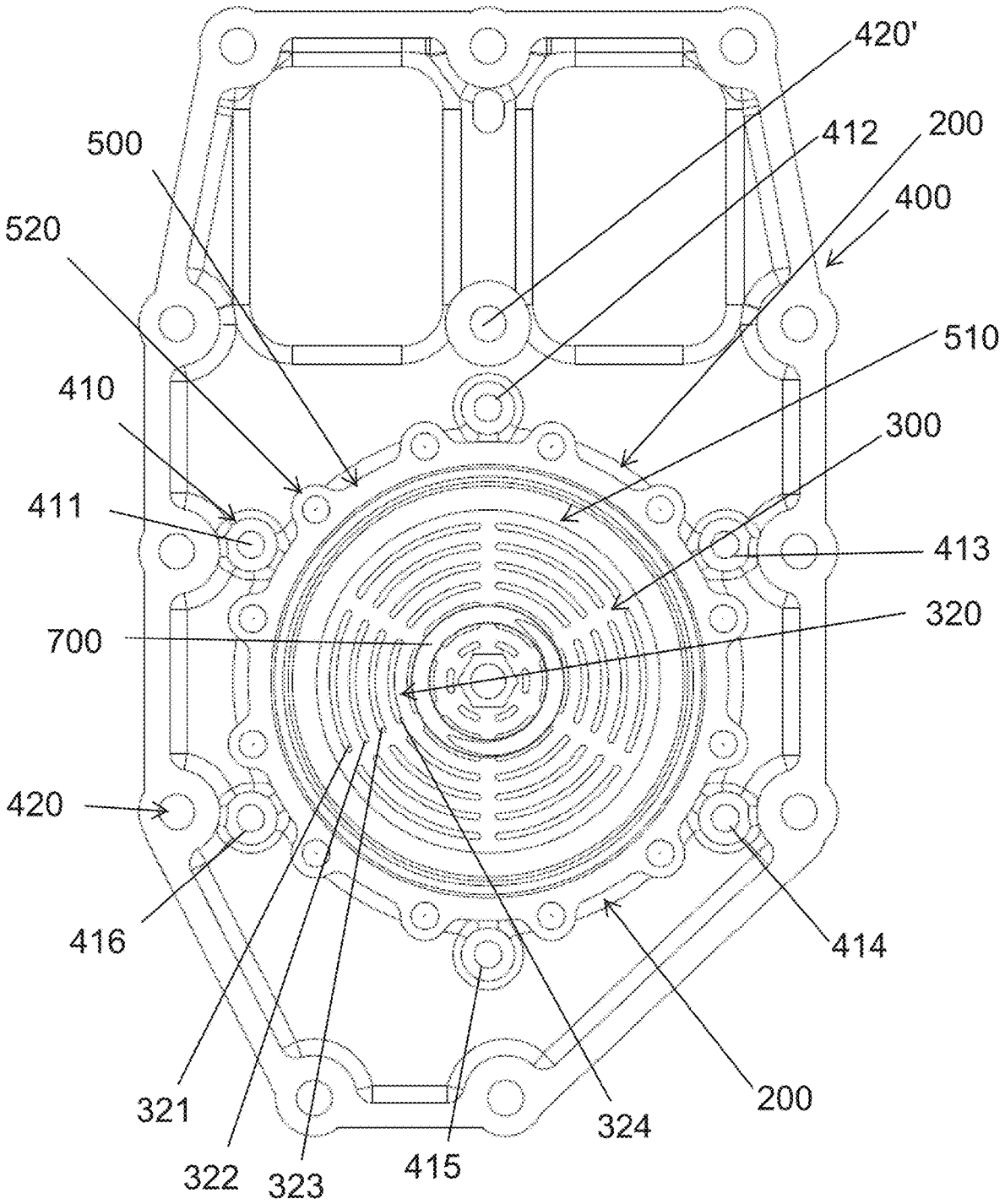
FIG. 5 shows a plan view of the cylinder head shown in FIG. 3.

Referring briefly to the plan view shown in FIG. 5, it can be seen that the discharge valve section 300 comprises a plurality of discharge ports 320. The plurality of discharge ports 320 comprise first 321, second 322, third 323, fourth 324 etc. discharge ports. The plurality of discharge ports 320 are each configured to provide fluid communication through the discharge valve section 300 such that working fluid can be discharged through the discharge ports 320 out of the working chamber in use.

The discharge ports 320 in the presently described example are provided as curved slots in the discharge valve section 300. It will be understood that the discharge ports 320 in alternative examples may be provided as circular holes, rectangular slots or any other shape provided that fluid communication is provided across the discharge valve section 300 in use.

Referring again to FIGS. 3 and 4, the discharge valve section 300 comprises a stopper plate 331. The stopper plate 331 is arranged to arrest the movement of a reed valve element (not shown) configured to open and close the discharge ports 320.

In the presently described example, the discharge valve section 300 is substantially flat and provided perpendicularly to the cylinder longitudinal axis. It will be appreciated that in other alternative examples, the discharge valve section 300 may be provided in a frustopyramidal or frustoconical form. Alternatively, the discharge valve section 300 may comprise a wedge-like cross-section as previously described.

As can be seen in FIGS. 3 and 4, the first discharge port 321 is configured to arrest the movement of the first finger blade 231'. The first discharge port 321 therefore provides the retaining function typically provided in prior art examples by a dedicated retainer or stop plate. However, by the first discharge port 321 being configured to arrest the movement of the first finger blade 231', the dedicated retainer or stop plate is not required. In prior art examples, a dedicated retainer or stop plate increases the dead volume within the working chamber, therefore it is advantageous to remove the dedicated retainer or stop plate particularly when the first finger blade 231' can be stopped by the first discharge port 321 without increasing the dead volume significantly.

Although not described herein, in the interest of brevity, it will be understood that each of the discharge ports 320 may be configured to arrest the movement of one of more of the finger blades. That is to say, in some examples, one discharge port may arrest the movement of multiple finger blades or all of the finger blades. In alternative examples, each discharge port may arrest the movement of a single finger blade. It will also be understood that not all discharge ports must arrest the movement of a finger blade. Furthermore, it will be understood that a combination of the discharge port provided arresting of some of the finger blades may be provided alongside other separate retainers or catches provided to arrest the movement of other finger blades.

Figure 3A:
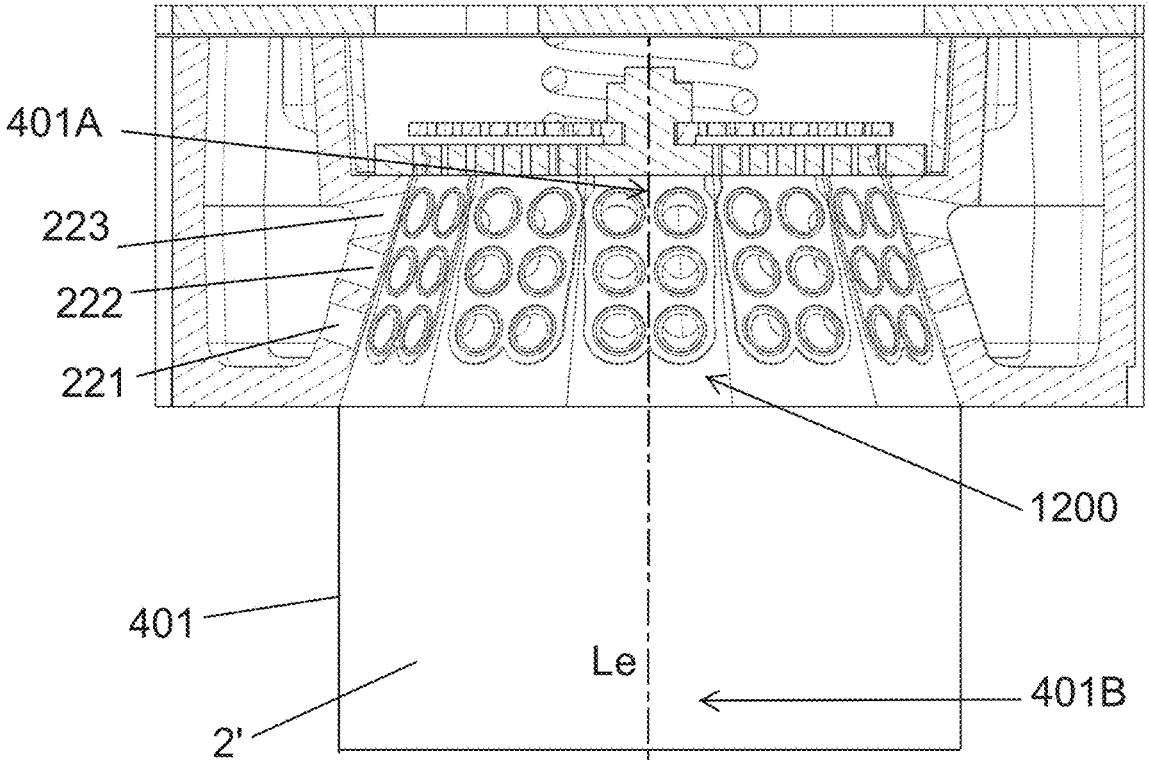
FIGS. 3*a* and 4*a* show the cross-sectional views shown in FIGS. 3 and 4, with a cylinder visible.
Figure 4A:
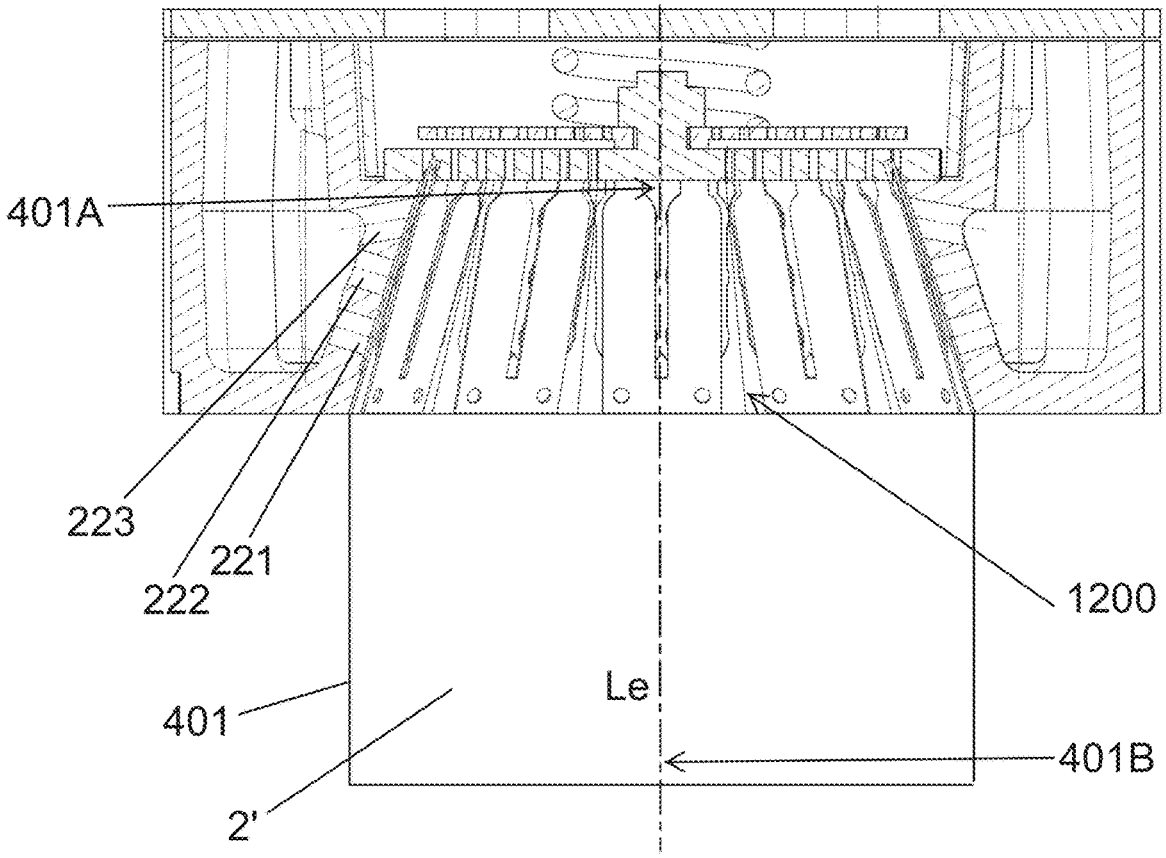

FIGS. 3*a* and 4*a* show the same arrangements as are shown in FIGS. 3 and 4 with a cylinder 401 now visible. As previously explained, the working chamber 2' is defined by a piston (not shown), the cylinder 401 and the working chamber head section 1200. The piston is not shown in the interest of clarity, since the piston reciprocates (i.e. moves up and down) in the cylinder 401 in use.

The working chamber 2' has an upper portion 401A and a lower portion 401B. It can be seen in FIG. 3*a* that the third suction port 223 is directed towards the upper portion 401A of the working chamber 2'. It can also be seen that the first 221 and second 222 suction ports are directed towards the lower portion 401B of the working chamber 2'.

It will be understood that in use the piston strokes from the upper portion 401A towards the lower portion 401B, from so called "top dead centre" (TDC) to so called "bottom dead centre" (BDC) when the piston compressor is performing the suction stroke. In this connection, as the piston leaves the TDC position, the majority of the working fluid flow by suction into the working chamber 2' should be directed towards the upper portion 401A of the working chamber 2'. By providing the third suction port 223 with an upwards inclination, working fluid is delivered from the third suction port 223 to the upper portion 401A of the working chamber 2' through the third suction port 223.

As the piston continues to move downwards, the working chamber 2' to be filled with working fluid from the plurality of suction ports 220 is expanded. In this connection, as the piston continues to move downwards (i.e. towards and into the lower portion 401B) working fluid is delivered to the working chamber 2' from the first 221 and second 222 ports which are conveniently directed towards the lower portion 401B of the working chamber 2'. By providing the first 221 and second 222 suction ports with a downwards inclination, working fluid is delivered from the first 221 and second 222 suction ports to the lower portion 401B of the working chamber 2' through the first 221 and second 222 suction ports.

Furthermore, in the described example, the first finger blade 231' is arranged such that the first finger blade 231' opens from the side closer to the upper portion 401A of the working chamber 2'. It is advantageous to direct the ports positioned at the opening end of the finger blades away from the finger blades as the finger blades open. That is to say, improvements in fluid flow may be provided by directing the flow through the third port 223 in an upwards direction whilst the first finger blade 231' opens in a downwards direction. Said another way, the flow through the third port 223 is directed towards the upper portion 401A whilst the first finger blade 231' opens in a direction towards the lower portion 401B.

In some examples each of the plurality of suction ports 220 may be directed at a particular inclination (either upwards or downwards). Alternatively, only some of the plurality of suction ports 220 may be directed at a particular inclination (either upwards or downwards) in some alternative examples.

The term inclination is intended to mean that the suction port referred to is directed into the working chamber non-perpendicularly to the longitudinal axis Le. The term upwards is intended to refer to the example described with reference to the Figures and the viewing orientation provided. Therefore, more generally, the term upwards is referring to the direction of the suction port towards the upper portion 401A whilst the term downwards is referring to the direction of the suction port towards the lower portion 401B.

It will be understood that each suction port of the plurality of suction ports 220 may be provided as a substantially straight port, or alternatively one or more suction ports of the plurality of suction ports 220 may be provided with a portion arranged perpendicularly to the cylinder longitudinal axis Le. In this connection, a suction port may comprise a portion perpendicular to the cylinder longitudinal axis Le and be arranged to deliver working fluid therethrough in a fluid flow path not perpendicular to the cylinder longitudinal axis Le. For example, the suction port may comprise a perpendicularly arranged portion which transitions into a curved or inclined portion further along the flow path through the suction port.

Therefore, in the present disclosure, the terms inclination, upwards and downwards refer to the fluid flow path as the fluid leaves the suction port, rather than the specific configuration of the suction port—i.e. the specific shape of the port within the material it is bored from, for example.

Figure 3B:
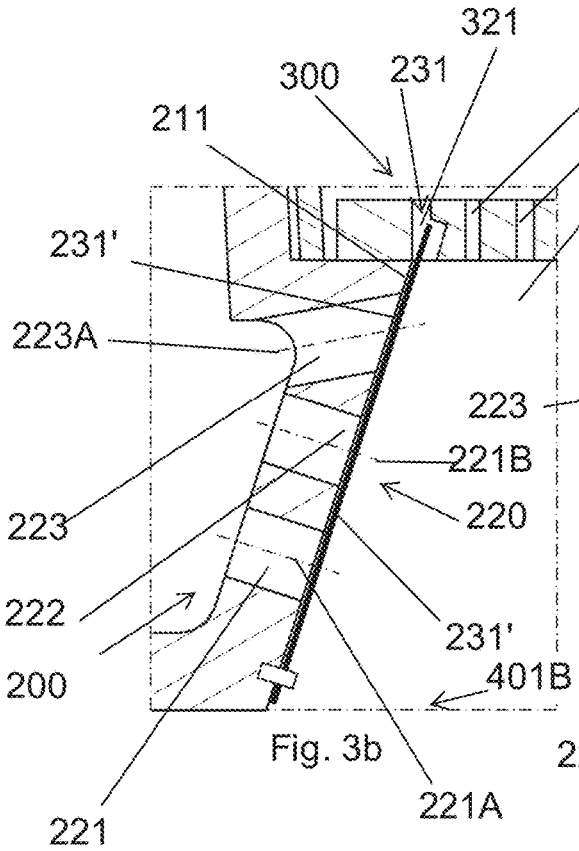
FIGS. 3*b* and 3*c* show detail views of the suction valve section shown in FIG. 4.

The terms upwards and downwards inclination are used relative to the orientation shown in FIGS. 3*a* and 3*b*. It will be understood that these terms are intended to mean that the respective port is directed towards the upper 401A or lower 401B portions of the working chamber 2'. The exact inclination provided will depend on many factors relating to the exact geometry and configuration of the working chamber head section 1200 and cylinder 401.

Figure 3C:
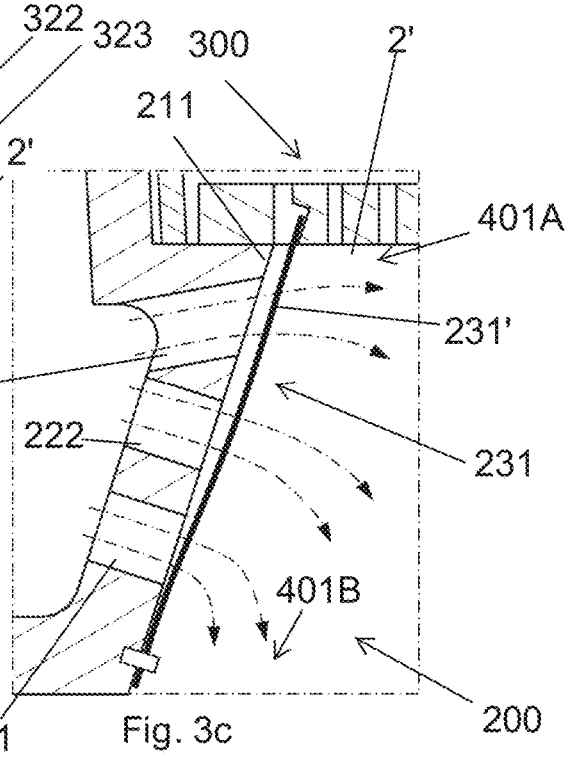

Referring now to FIGS. 3*b* and 3*c*, there is provided a detailed view of the suction valve section 200 shown in FIG. 4.

Again, it will be understood that the suction valve section 200 is to allow working fluid to be sucked into a working chamber 2' (only partially shown in FIGS. 3*b* and 3*c*) of the piston compressor in use. Similarly, the discharge valve section 300 is to allow working fluid to be discharged from the working chamber 2' of the piston compressor in use.

The arrangement of the suction valve section 200 is to provide improved performance of the compressor by improving the fluid flow through the suction valve section 200 without impacting the dead volume substantially.

As previously explained, and as can now clearly be seen in FIGS. 3*b* and 3*c*, the first lateral face 211 comprises a plurality of suction ports 220 comprising first 221, second 222, third 223, and further (not visible in FIGS. 3*b* and 3*c*) suction ports. The suction ports 220 are configured to provide fluid communication through the suction valve section 200 such that working fluid can be sucked through the suction ports 220 into the working chamber 2' in use.

FIGS. 3*b* and 3*c* show the first finger blade 231' of the first reed valve 231 in the closed position and open position, respectively.

The first finger blade 231' is retained without the use of a separate retainer, as in the prior art, as will now be explained in further detail.

The discharge valve section 300 comprises first 321, second 322, third 323 etc. discharge ports.

As previously explained the first discharge port 321 is configured to arrest the movement of the first finger blade 231'. In this connection, the first discharge port 321 may be registered with the form of the first finger blade 231' such that the first finger blade 231' can be received in the first discharge port 231 and arrest the movement of the first finger blade 231' in use. The first discharge port 321 therefore provides the retaining function typically provided in prior art examples by a dedicated retainer or stop plate. However, by the first discharge port 321 being configured to arrest the movement of the first finger blade 231', the dedicated retainer or stop plate is not required.

Referring specifically to FIG. 3*c*, it can be seen that when the first finger blade 231' moves to the open position, the first finger blade 231' is retained by the first discharge port 321.

The first discharge port 321 may also be specifically formed and arranged to align with the orientation and geometry of the first finger blade 231' during operation, such that optimal blade movement may be achieved. Furthermore, this may reduce friction and wear.

As previously explained, the first finger blade 231' is arranged such that the first finger blade 231' opens from the side closer to the upper portion 401A of the working chamber 2'. It is advantageous to direct the ports positioned at the opening end of the finger blades away from the finger blades as the finger blades open. That is to say, improvements in fluid flow may be provided by directing the flow through the third port 223 in an upwards direction whilst the first finger blade 231' opens in a downwards direction. Said another way, the flow through the third port 223 is directed towards the upper portion 401A whilst the first finger blade 231' opens in a direction towards the lower portion 401B.

As can be seen most clearly in the detail views provided in FIGS. 3*b* and 3*c*, the first 221 and second 222 ports are arranged such that their respective longitudinal port axes 221A, 222B are perpendicular to the first finger blade 231' and the internal form of the suction valve section 200 inside the working chamber 2'. On the contrary, the third port 223 is arranged such that a longitudinal port axis 223A is not perpendicular to the first finger blade 231' and the internal form of the suction valve section 200 inside the working chamber 2'.

The presently described arrangement of providing upper ports directed non-perpendicularly to the first finger blade 231' allows said ports to direct fluid to an upper portion 401A of the working chamber 2', whilst the lower ports direct fluid to a lower portion of the working chamber 2'. As the working chamber 2' to be filled with working fluid from the plurality of suction ports 220 is expanded (i.e. when the piston moves downwards) the lower ports (in this case first 221 and second 222 ports) serve to provide working fluid to the lower portion of the working chamber 2' whilst the upper port or ports (in this case the third port 223) serves to provide working fluid to the upper portion 401A.

Figure 3D:
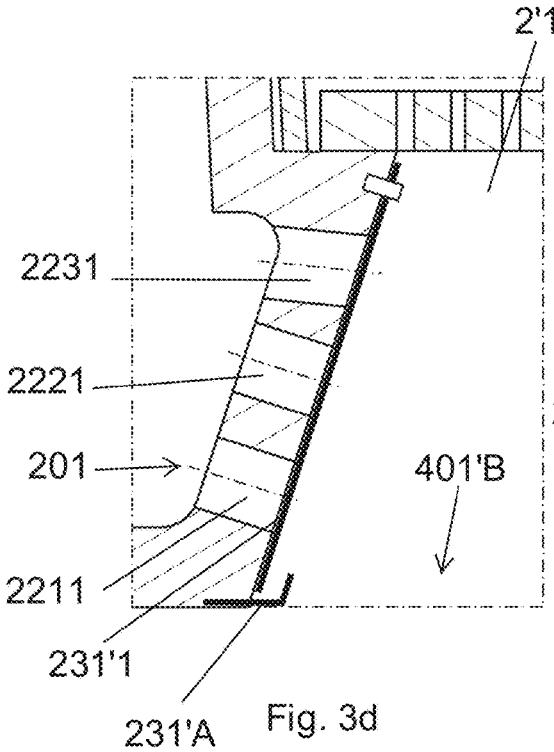
FIGS. 3*d* and 3*e* show a first alternative finger blade arrangement.
Figure 3E:
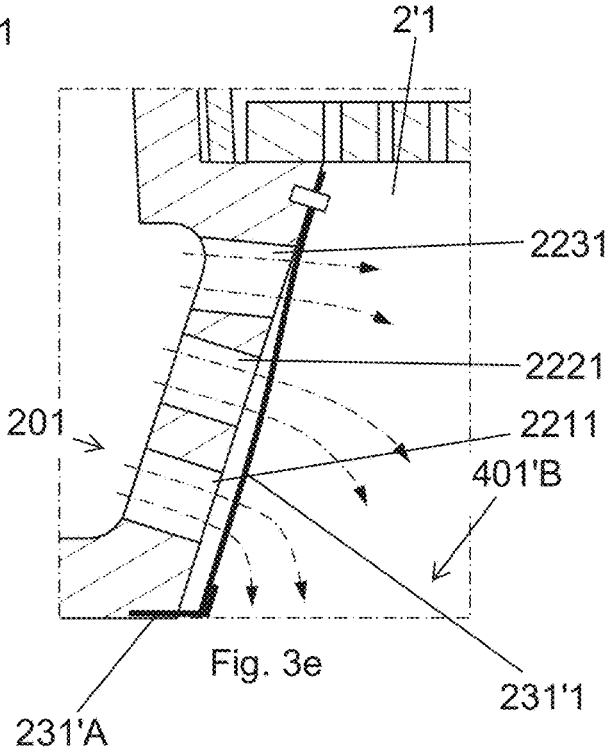

Referring now to FIGS. 3*d* and 3*e*, there is provided an alternative first finger blade 231'1 arrangement, wherein FIG. 3*d* shows the first finger blade 231'1 in the closed position and FIG. 3*e* shows the first finger blade 231'1 in the open position. The arrangement is similar to the above-described arrangement provided in FIGS. 3*b* and 3*c*. However, the first finger blade 231'1 is arranged to open from the side closer to the lower portion 401'B of the working chamber 2'1. The first finger blade 231'1 is arranged to open and close first 2211, second 2221 and third 2231 ports, similarly to the previously described example. However, in the presently described example shown in FIGS. 3*d* and 3*e*, the first finger blade 231'1 is not arrested and retained by the discharge ports. Instead, there is provided a stopper catch 231'A configured to arrest the movement of the first finger blade 231'1, as shown in FIG. 3*e*. The stopper catch 231'A is a relatively small catch protruding from the internal surface of the suction valve section 201 and configured to arrest further opening movement of the first finger blade 231'1. In this connection, a dedicated retainer or stop plate is not required. In prior art examples, a dedicated retainer or stop plate increases the dead volume within the working chamber, therefore it is advantageous to remove the dedicated retainer or stop plate and instead provide arresting of the first finger blade 231'1 with the stopper catch 231'A, without significantly increasing the dead volume.

Although not described herein, in the interest of brevity, it will be understood that in some examples there may be provided multiple stopper catches 231'A configured to arrest the movement of one of more of the finger blades. That is to say, in some examples, one stopper catch 231'A may arrest the movement of multiple finger blades or all of the finger blades. In alternative examples, each stopper catch 213'2 may arrest the movement of a single finger blade.

Figures 3F, 3G:
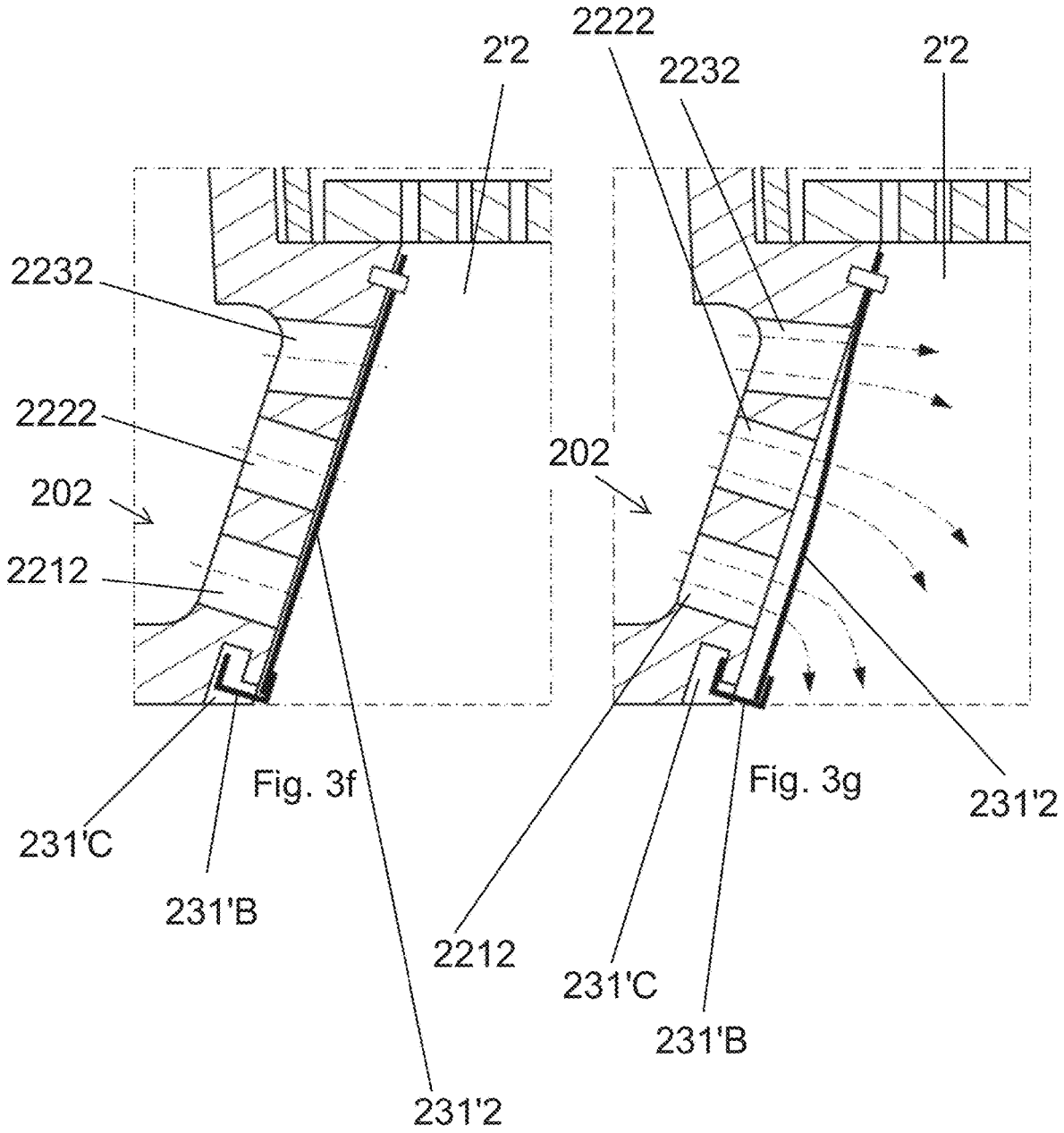
FIGS. 3*f* and 3*g* show a second alternative finger blade arrangement.

Referring now to FIGS. 3*f* and 3*g*, there is provided an alternative second finger blade 231'2 arrangement, wherein FIG. 3*f* shows the second finger blade 231'2 in the closed position and FIG. 3*g* shows the second finger blade 231'2 in the open position. The arrangement is similar to the above-described arrangement provided in FIGS. 3*d* and 3*e*. The second finger blade 231'2 is arranged to open and close first 2212, second 2222 and third 2232 ports, similarly to the previously described example. However, in the presently described example shown in FIGS. 3*f* and 3*g*, the second finger blade 231'2 is not provided with a stopper catch protruding from the internal surface of the suction valve section and configured to arrest further opening movement of the finger blade. Instead, as can clearly be seen in FIGS. 3*f* and 3*g*, the second finger blade 231'2 is arranged with a hook 231'B attached to the opening end of the second finger blade 231'2. In the presently described example the hook 231'B is a separate component attached to the end of the second finger blade 231'2. In alternative examples (not shown) the second finger blade 231'2 and hook 231'B may be integrally formed. In alternative examples (not shown) the arresting of the finger blade 231'2 may be provided by formations other than hooks, such as pins, needles, notches or any other suitable formation formed or attached at the opening end of the finger blade 231'2. Such formations may similarly be registered with a recess 231'C or another geometry shaped for the purpose of catching such formations.

Still referring to FIGS. 3*f* and 3*g*, the suction valve section 202 comprises recess 231'C configured to register with the shape of the hook 231'B such that the hook 231'B can move within the recess 231'C but is arrested in its outwards movement. By connection of the hook 231'B with the second finger blade 231'2, the movement of the second finger blade 231'2 is also arrested in a similar way to the previously described examples, but without the need to form a protruding feature into the working chamber 2'2.

Figure 6:
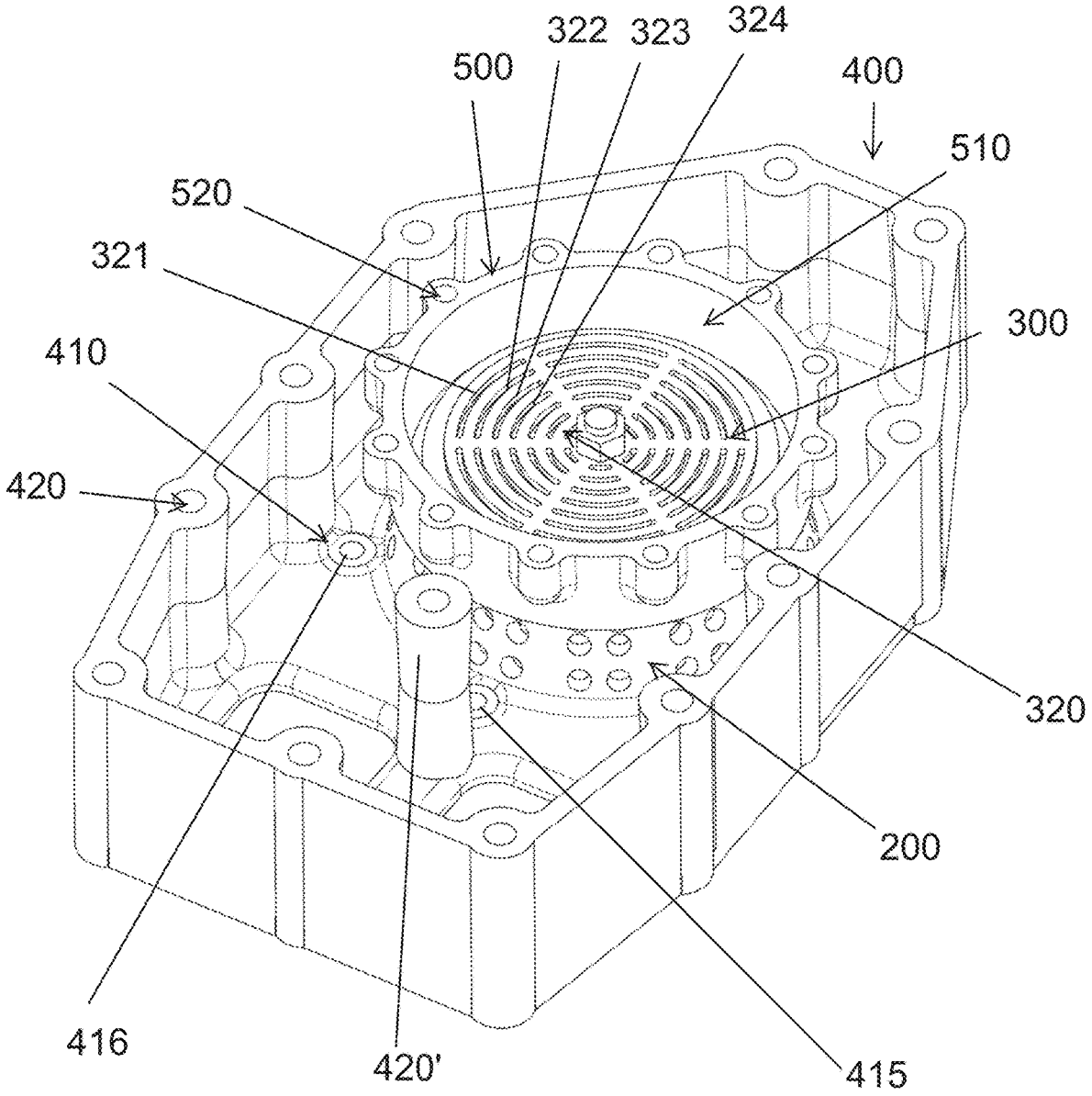
FIG. 6 shows an isometric view of the cylinder head shown in FIG. 3.

In prior art examples, a dedicated retainer or stop plate inside the working chamber increases the dead volume within the working chamber, therefore it is advantageous to remove the dedicated retainer or stop plate and instead provide arresting of the second finger blade 231'2 with the hook 231'B and correspondingly formed recess 231'C, without significantly increasing the dead volume. Referring to FIGS. 5 and 6, further details of a possible arrangement of the cylinder head 400 is now provided. FIG. 5 shows a plan view of the cylinder head 400 and FIG. 6 shows an isometric view of the cylinder head 400.

The cylinder head 400 comprises the previously described suction valve section 200 (not visible in FIGS. 5 and 6) and discharge valve section 300. The cylinder head 400 comprises a plurality of cylinder head bolt bosses 410 comprising first 411, second 412, third 413, fourth 414, fifth 415 and sixth 416 cylinder head bosses, each configured to receive a cylinder head bolt (not shown) to secure the cylinder head 400 to the cylinder (not shown) in use.

The cylinder head 400 further comprises an extended cup 500 forming a discharge channel 510. The discharge channel 510 allows discharged working fluid to be removed from the working chamber 2' (not visible in FIGS. 5 and 6) through the discharge channel 510 as will be explained in more detail later. The extended cup 500 comprises a plurality of discharge valve section bolt bosses 520 comprising twelve discharge valve section bosses, each configured to receive a discharge valve section bolt (not shown) to secure a top plate 600 (shown in FIGS. 3 and 4) to the cylinder head 400 in use.

Referring now to FIGS. 3 to 6, it can be seen that the suction valve section 200 is extended at its upper end to form the extended cup 500. By extension of the suction valve section 200, the plurality of discharge valve section bolt bosses 520 do not need to extend in front of the suction valve section 200 which would block the working fluid flow path into the suction valve section 200. Therefore, the extended cup 500 allows the working fluid flow path into the suction valve section 200 to be kept clear such that the fluid flow can be optimised, leading to better performance of the piston compressor.

Still referring to FIGS. 3 to 6, it can be seen that the cylinder head 400 comprises a plurality of outer bolt bosses 420 comprising twelve outer bolt bosses (including one boss 420' placed in a more central location of the cylinder head 400), each configured to receive an outer bolt (not shown) to secure the top plate 600 (shown in FIGS. 3 and 4) and the cylinder head 400 in use to a main compressor block (not shown).

It will now be appreciated that a suction channel 200A is formed which is free of obstruction to allow a smooth fluid flow of working fluid being sucked into the working chamber in use. The discharge channel 510 can also be clearly seen in FIGS. 3 and 4, as previously described.

In summary, the cylinder head 400 is attached to the cylinder in use by means of cylinder head bolts (not shown) provided through the cylinder head bolt bosses 410. The top plate 600 is attached to the extended cup 500 by discharge valve section bolts (not shown) provided through discharge valve section bolt bosses 520. The top plate 600 is attached to the cylinder head 400 at the outer portion of the cylinder head 400 by means of outer bolts (not shown) provided through outer bolt bosses 420, 420'.

In some alternative examples (not shown) the discharge channel 510 may be provided with a separate discharge pipe which can advantageously be fixed to the cylinder head 400 and the top plate 600 by the same discharge valve section bolts secured in the discharge valve section bolt bosses 520.

It is highly desirable that a very tight seal is formed between the extended cup 500 and the top plate 600, therefore a first gasket (not shown) is provided between the extended cup 500 and the top plate 600. Furthermore, it is highly desirable that a very tight seal is formed between the cylinder head 400 and the top plate 600 at the outer bolts, therefore a second gasket (not shown) is provided between the cylinder head 400 and the top plate 600.

Referring now to FIGS. 3 to 5, the discharge valve section 300 is provided with a hydrolock prevention means in the form of a spring 700. As previously explained, the discharge valve section 300 comprises a stopper plate 331. The stopper plate 331 is arranged to arrest the movement of a reed valve element (not shown) configured to open and close the discharge ports 320. During normal operation of the compressor, the spring 700 secures the stopper plate 331 to the cylinder head 400 instead of using for example threaded bolts. If a large amount of liquid should be present in the working chamber during compression and/or discharge stroke due to a fault in the operation of the compressor, the stopper plate 311 will lift by pushing the spring 700 upwards, and thus prevent major damage to the compressor resulting from the otherwise excessive forces on the stopper plate 311.

In alternative examples (not shown), the hydrolock prevention means may be provided in the form of a plurality of springs. In some examples, the plurality of springs may be spaced near to the circumference of the stopper plate 331. In some examples, there may be provided only a plurality of springs located near the circumference of the stopper plate 331, whereas in other examples there may be springs located near the circumference of the stopper plate 331 as well as one or more springs at the centre of the stopper plate 331. Where a plurality of springs are used, it will be appreciated that the force required of each spring is reduced as the load is shared across the plurality of springs. Providing some or all of the springs near the circumference of the stopper plate 331 may provide improved flow in the discharge channel 510 compared with a single centrally located spring 700.

Referring again to FIGS. 3 and 4, there is further provided a thermal insulation element 800 arranged between the discharge channel 510 and the suction channel 200A. It will be appreciated that, when the piston compressor is used in a high-temperature heat pump, the suction channel 200A channels low-temperature working fluid and the discharge channel 510 channels high-temperature working fluid. The thermal insulation element 800 is provided to reduce or eliminate thermal leakage between the suction 200A and discharge channels 510.

Although in the presently described example the suction valve section 200 is provided entirely in the frustopyramidal section and the discharge valve section 300 is provided entirely in the section at 90 degrees to the cylinder longitudinal axis, it will be understood that in alternative examples some of the frustopyramidal section may be used as part of the discharge valve section and/or some of the section at 90 degrees to the cylinder longitudinal axis may be used as part of the suction valve section. It is therefore now reinforced that the terms frustopyramidal and frustoconical are used herein to refer to the general shape of the suction section, and do not exclude the possibility that a portion, such as two or four lateral faces for example, are used as part of the discharge valve section. Additionally, the terms frustopyramidal and frustoconical do not exclude the possibility that a portion, such as two or four lateral faces for example, are used for another purpose or are missing—in the present context, the form is still considered to be frustopyramidal or frustoconical in such cases.

Figure 7:
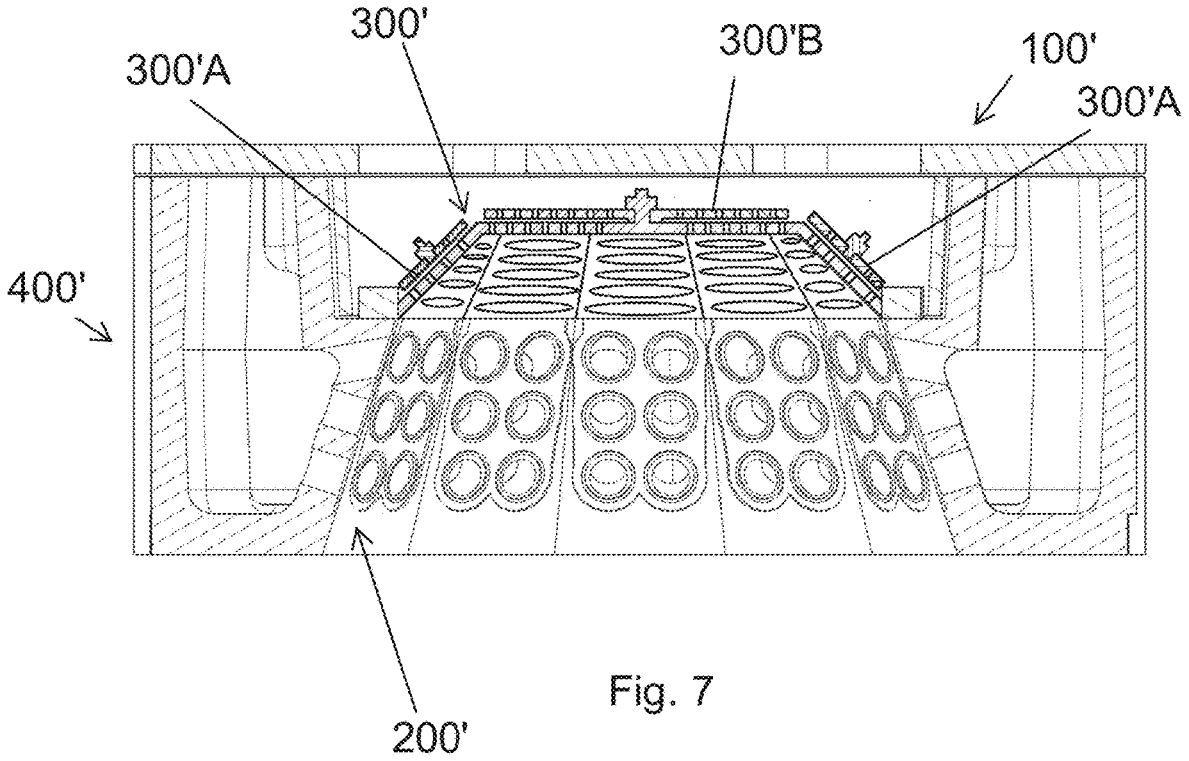
FIG. 7 shows a cross-sectional view through an alternative cylinder head.

Referring to FIG. 7, there is shown an alternative valve arrangement 100' for a piston compressor (not shown). The valve arrangement 100' comprises main components of a suction valve section 200' and a discharge valve section 300'. The valve arrangement 100' is shown as it is utilised in a cylinder head 400' of a piston compressor. Much of the arrangement of the alternative valve arrangement 100' is the same as the valve arrangement described with reference to FIGS. 3 to 6, therefore a detailed explanation is not provided in the interest of brevity. The difference between the arrangement described with reference to FIGS. 3 to 6 and the alternative arrangement shown in FIG. 7 is that the discharge valve section 300' is configured in an entirely flat arrangement in FIGS. 3 to 6 and is configured partially at an angle in FIG. 7. In this connection, it can be seen that the discharge valve section 300' has a first portion 300'A which is frustoconical and a second portion 300'B which is flat and provided perpendicularly to the cylinder axis. As previously explained, the discharge valve section 300' in other examples may be provided in various configurations. For example, the discharge valve section 300' may be provided as a cone, a pyramid, a frustocone or a frustopyramid.

As previously discussed, a frustum in geometry is a three-dimensional geometric shape formed by the volume between two parallel planes and a polyhedron, often a pyramid or cone. Therefore, in geometry, a truncated conical shape is the same as a frustoconical shape and a truncated pyramidal shape is the same as a frustopyramidal shape. In the present disclosure, the terms frustoconical and frustopyramidal are not restricted to geometries between two parallel planes. Although it may often be convenient to provide valve section geometries between two parallel planes, the terms frustopyramidal and frustoconical are not restricted to truncations between two parallel planes. Instead, it will be understood that the truncations may be formed between two non-parallel planes.

As previously discussed, compressors can have one or more cylinders, and each cylinder has its corresponding set of suction and discharge valves sections. Throughout the above disclosure, reference is made to single cylinders (and corresponding pistons, suction and discharge valve sections etc.) for the sake of clarity and brevity. It will be understood that any single cylinder may be a single cylinder within a system of multiple cylinders (and corresponding pistons, suction and discharge valve sections etc). In this connection, one or more of the cylinders of a multi-cylinder system may be as described herein. In some examples, all of the cylinders of a multi-cylinder system may be as described herein. In some examples, all of the cylinders of a multi-cylinder system may be as described herein and be substantially the same configuration.

Figure 8:
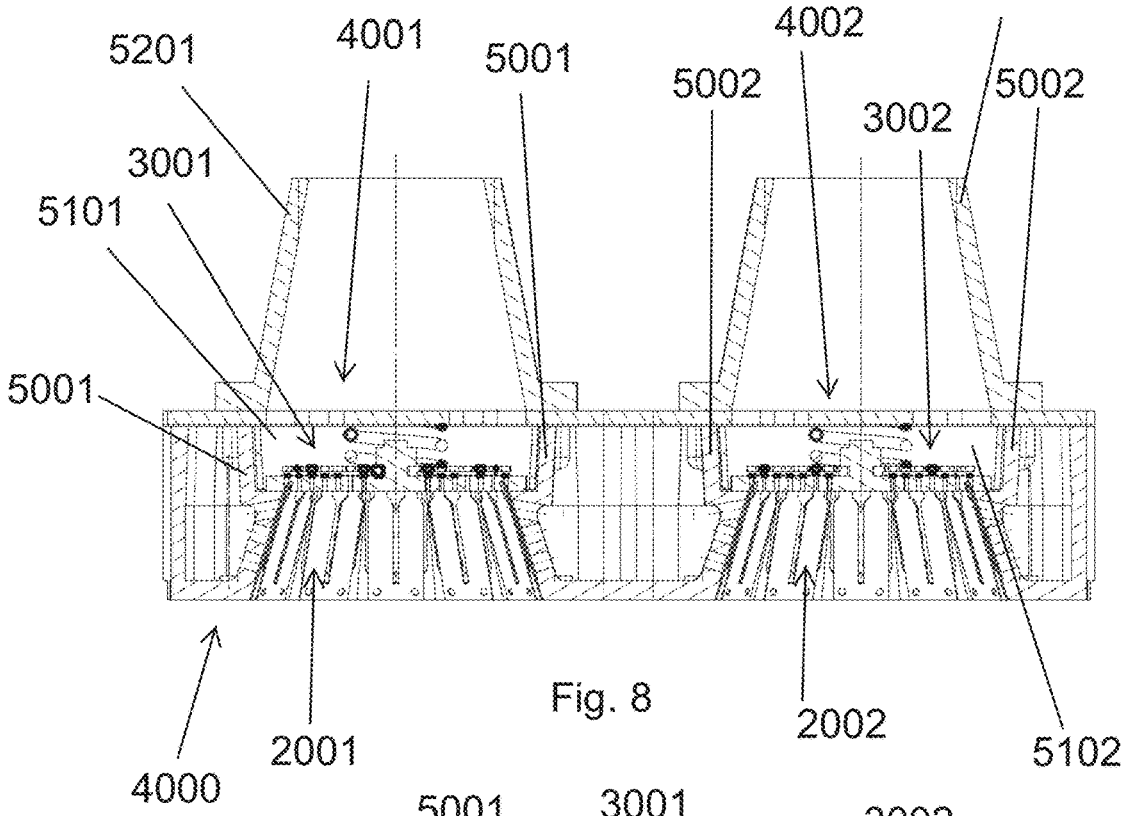
FIG. 8 shows a cross-sectional view through a multi-cylinder cylinder head.
Figure 9:
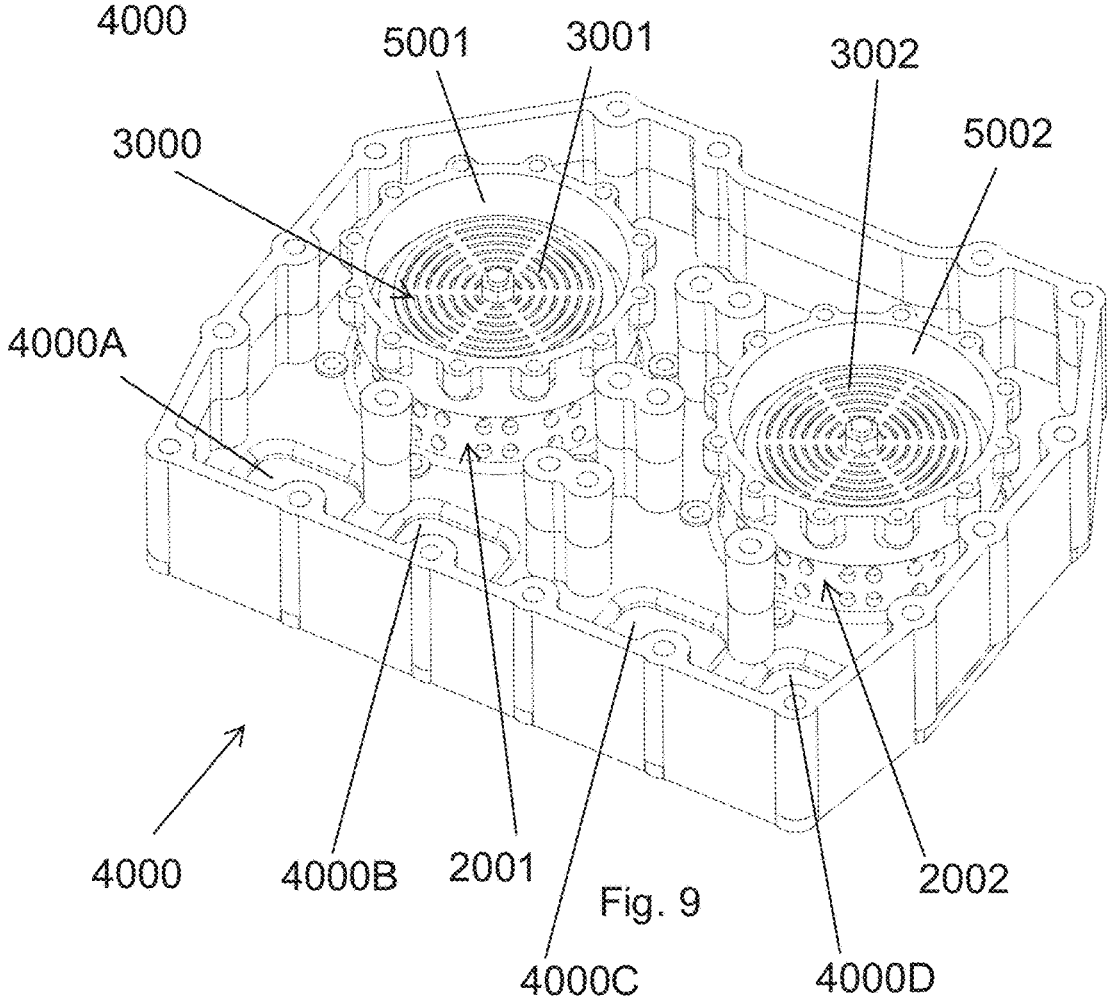
FIG. 9 shows an isometric view of the multi-cylinder cylinder head shown in FIG. 8.

Referring now to FIGS. 8 and 9 an alternative arrangement of a cylinder head 4000 is now described. The cylinder head 4000 is configured to be arranged with two cylinders. In the interest of brevity, only a two-cylinder cylinder head 4000 is described, although it will be appreciated that in other examples (not shown) there may be provided cylinder heads for assembly with three, four, five, six or more cylinders.

FIG. 8 shows a cross-sectional view through the cylinder head 4000 and FIG. 9 shows an isometric view of the cylinder head 4000.

The cylinder head 4000 comprises a first head section 4001 and a second head section 4002. The first head section 4001 is configured to deliver and receive working fluid from the working chamber of a first cylinder (not shown) attached to the first head section 4001 in use, and the second head section 4002 is configured to deliver and receive working fluid from the working chamber of a second cylinder (not shown) attached to the second head section 4002 in use.

The first head section 4001 comprises a first suction valve section 2001 and a first discharge valve section 3001. Likewise, the second head section 4002 comprises a second suction valve section 2002 and a second discharge valve section 3002. The first and second suction valve sections 2001, 2002 and first and second discharge valve sections 3001, 3002 are substantially the same as the suction valve section 200 and discharge valve section 300 previously described, therefore repetition of these details is omitted here for the sake of brevity.

Furthermore, as in the previously described example, the first head section 4001 comprises a first extended cup 5001 forming a first discharge channel 5101 and the second head section 4002 comprises a second extended cup 5002 forming a second discharge channel 5102.

The discharge channels 5101, 5102 allows discharged working fluid to be removed from the working chamber as previously described.

As shown in FIG. 8, there is provided first 5201 and second 5202 discharge funnels configured to receive and remove discharged working fluid from the discharge channels 5101, 5102. Optionally, in some examples, there may be provided a common manifold (not shown) to which the first 5201 and second 5202 discharge funnels lead to.

Referring now to FIG. 9, the cylinder head 4000 is shown in an isometric view without a top plate or discharge funnels, in the interest of clarity.

The cylinder head 4000 comprises first 4000A, second 4000B, third 4000C and fourth 4000D suction passages. Although in the presently described example four suction passages 4000A, 4000B, 4000C, 4000D are provided, it will be understood that in alternative examples any number of suction passages may be provided. Advantageously, each of the suction passages 4000A, 4000B, 4000C, 4000D serves to deliver working fluid from a common suction chamber (not shown) to both the first suction valve section 2001 and the second suction valve section 2002. That is to say when working fluid is to be delivered to the first suction valve section 2001, working fluid may be drawn through any or all of the four suction passages 4000A, 4000B, 4000C, 4000D from the common suction chamber (not shown).

During cyclic operation of the two adjacent cylinders (not shown) that are served with working fluid from the cylinder head 4000, flow restrictions may be reduced. Furthermore, the described arrangement may provide a larger working fluid buffer, which in turn may reduce pressure fluctuations in the cylinder head 4000. Furthermore, as can be seen clearly in FIG. 9, working fluid delivered to the first 2001 or second 2002 suction valve sections through the suction passages 4000A, 4000B, 4000C, 4000D may flow more freely to and between each suction valve section 2001, 2002, compared with the previously described arrangements whereby each suction valve section is not in direct open fluid communication with another suction valve section, such that flow restrictions and hence pressure fluctuations may be mitigated.

The invention claimed is:

1. A valve arrangement for a piston compressor, the valve arrangement comprising:

a suction valve section; and a discharge valve section;

wherein the suction valve section and discharge valve section together form a working chamber head section, and the suction valve section has a frustopyramidal form.

2. The valve arrangement according to claim 1, wherein the suction valve section comprises at least a first self-actuated check valve.

3. The valve arrangement according to claim 2, wherein the frustopyramidal form of the suction valve section comprises a plurality of lateral faces, wherein the first self-actuated check valve is located on a first lateral face of the plurality of lateral faces of the suction valve section.

4. The valve arrangement according to claim 2, wherein the first self-actuated check valve comprises a first reed suction valve.

5. The valve arrangement according to claim 4, wherein:

the suction valve section comprises at least a first suction port configured to provide fluid communication through the suction valve section; and the first reed suction valve comprises at least a first finger blade arranged to open and close the first suction port.

6. The valve arrangement according to claim 5, further comprising a first finger catch configured to arrest movement of the first finger blade.

7. The valve arrangement according to claim 5, wherein the discharge valve section comprises a first discharge port configured to provide fluid communication through the discharge valve section and to arrest movement of the first finger blade.

8. The valve arrangement according to claim 1, wherein the valve arrangement has a central axis configured to be aligned with a longitudinal axis of a cylinder of the piston compressor in use, wherein the discharge valve section is configured perpendicularly to the central axis, such that in use the discharge valve section is at or substantially at 90 degrees to the longitudinal axis of the cylinder.

9. A piston compressor comprising:

a cylinder comprising a longitudinal axis;

a piston mounted in the cylinder and linearly moveable along the longitudinal axis; and a valve arrangement according to claim 1.

10. The piston compressor according to claim 9, wherein the piston comprises a piston head section registered with the working chamber head section.

11. A method of optimizing fluid flow through a valve arrangement, comprising the steps of:

a. providing a valve arrangement according to claim 1;

b. sucking a working fluid through the suction valve section; and c. discharging the working fluid through the discharge valve section.

12. A method of operating a piston compressor, comprising the steps of:

a. providing a piston compressor according to claim 9;

b. sucking a working fluid through the suction valve section into the cylinder;

c. compressing the working fluid by linearly moving the piston along the longitudinal axis; and d. discharging the working fluid out of the cylinder through the discharge valve section.

13. A valve arrangement for a piston compressor, the valve arrangement comprising:

a suction valve section; and a discharge valve section;

wherein the suction valve section and discharge valve section together form a working chamber head section, and the suction valve section has a substantially frustoconical form comprising at least a first flat lateral surface.

14. The valve arrangement according to claim 13, wherein the suction valve section comprises at least a first self-actuated check valve located on the first flat lateral surface.

15. The valve arrangement according to claim 14, wherein the first self-actuated check valve comprises a first reed suction valve.

16. The valve arrangement according to claim 15, wherein:

the suction valve section comprises at least a first suction port configured to provide fluid communication through the suction valve section; and the first reed suction valve comprises at least a first finger blade arranged to open and close the first suction port.

17. The valve arrangement according to claim 16, further comprising a first finger catch configured to arrest movement of the first finger blade.

18. The valve arrangement according to claim 13, wherein the valve arrangement has a central axis configured to be aligned with a longitudinal axis of a cylinder of the piston compressor in use, wherein the discharge valve section is configured perpendicularly to the central axis, such that in use the discharge valve section is at or substantially at 90 degrees to the longitudinal axis of the cylinder.

19. A valve arrangement for a piston compressor, the valve arrangement comprising:

a suction valve section; and a discharge valve section having a frustopyramidal form;

wherein the suction valve section and discharge valve section together form a working chamber head section.

20. A valve arrangement for a piston compressor, the valve arrangement comprising:

a suction valve section; and a discharge valve section having a substantially frustoconical form comprising at least a first flat lateral surface;

wherein the suction valve section and discharge valve section together form a working chamber head section.

* * * * *